US007832838B2

(12) United States Patent
Karppinen et al.

(10) Patent No.: US 7,832,838 B2
(45) Date of Patent: Nov. 16, 2010

(54) PRINTHEAD WITH EXTERIOR SURFACE PROFILED FOR WIPING MAINTENANCE STATION

(75) Inventors: Vesa Karppinen, Balmain (AU); John Douglas Peter Morgan, Balmain (AU); Michael John Hudson, Balmain (AU); Asanga Gunatilake, Balmain (AU); Laval Chung-Long-Shan, Balmain (AU); Martin Tiong We Tay, Balmain (AU); Akira Nakazawa, Balmain (AU); Norman Micheal Berry, Balmain (AU); Garry Raymond Jackson, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 367 days.

(21) Appl. No.: 12/014,770

(22) Filed: Jan. 16, 2008

(65) Prior Publication Data

US 2009/0179963 A1 Jul. 16, 2009

(51) Int. Cl.

| | |
|---|---|
| ***B41J 2/155*** | (2006.01) |
| ***B41J 2/015*** | (2006.01) |
| ***B41J 2/165*** | (2006.01) |
| ***B41J 2/15*** | (2006.01) |
| ***B41J 2/14*** | (2006.01) |
| ***B41J 2/04*** | (2006.01) |

(52) U.S. Cl. ..... 347/42; 347/20; 347/22; 347/29; 347/40; 347/47; 347/49; 347/54

(58) Field of Classification Search ..... 347/20, 347/22, 29, 40, 42, 47, 49, 54
See application file for complete search history.

(56) References Cited

U.S. PATENT DOCUMENTS

| | | | | |
|---|---|---|---|---|
| 7,364,265 | B1 * | 4/2008 | Brown et al. | 347/42 |
| 2005/0157102 | A1 * | 7/2005 | Silverbrook | 347/85 |
| 2006/0098040 | A1 | 5/2006 | Kang | |
| 2007/0206079 | A1 * | 9/2007 | Brown et al. | 347/94 |

FOREIGN PATENT DOCUMENTS

JP 09-150521 A 6/1997

* cited by examiner

*Primary Examiner*—Charlie Peng
*Assistant Examiner*—Hung Lam

(57) ABSTRACT

A printhead assembly with an elongate printhead IC having a nozzle face defining an array of nozzles, and a support structure for supporting the elongate printhead IC on an external surface such that its length is transverse to a media feed direction through the printer. The external surface has a section that is flush with a long side edge of the elongate printhead IC.

8 Claims, 7 Drawing Sheets

PRINTHEAD WITH EXTERIOR SURFACE PROFILED FOR WIPING MAINTENANCE STATION

FIELD OF THE INVENTION

The present invention relates to the field of inkjet printing and in particular, inkjet printers with pagewidth printheads.

CO-PENDING APPLICATIONS

The following applications have been filed by the Applicant simultaneously with the present application:

| | | | | |
|---|---|---|---|---|
| 12/014,767 | 12/014,768 | 12/014,769 | 12/014,771 | 12/014,772 |
| 12/014,773 | 12/014,774 | 12/014,775 | 12/014,776 | 12/014,777 |

-continued

| | | | | |
|---|---|---|---|---|
| 12/014,778 | 12/014,779 | 12/014,780 | 12/014,781 | 12/014,782 |
| 12/014,783 | 12/014,784 | 12/014,785 | 12/014,787 | 12/014,788 |
| 12/014,789 | 12/014,790 | 12/014,791 | 12/014,792 | 12/014,793 |
| 12/014,794 | 12/014,796 | 12/014,798 | 12/014,801 | 12/014,803 |
| 12/014,804 | 12/014,805 | 12/014,806 | 12/014,807 | |

The disclosures of these co-pending applications are incorporated herein by reference.

CROSS REFERENCES

The following patents or patent applications filed by the applicant or assignee of the present invention are hereby incorporated by cross-reference.

| | | | | | | |
|---|---|---|---|---|---|---|
| 6,276,850 | 6,520,631 | 6,158,907 | 6,539,180 | 6,270,177 | 6,405,055 | 6,628,430 |
| 6,835,135 | 6,626,529 | 6,981,769 | 7,125,338 | 7,125,337 | 7,136,186 | 7,286,260 |
| 7,145,689 | 7,130,075 | 7,081,974 | 7,177,055 | 7,209,257 | 6,443,555 | 7,161,715 |
| 7,154,632 | 7,158,258 | 7,148,993 | 7,075,684 | 10/943,905 | 10/943,906 | 10/943,904 |
| 10/943,903 | 10/943,902 | 6,966,659 | 6,988,841 | 7,077,748 | 7,255,646 | 7,070,270 |
| 7,014,307 | 7,158,809 | 7,217,048 | 11/225,172 | 11/255,942 | 11/329,039 | 11/329,040 |
| 7,271,829 | 11/442,189 | 11/474,280 | 11/483,061 | 11/503,078 | 11/520,735 | 11/505,858 |
| 11/525,850 | 11/583,870 | 11/592,983 | 11/592,208 | 11/601,828 | 11/635,482 | 11/635,526 |
| 10/466,440 | 7,215,441 | 11/650,545 | 11/653,241 | 11/653,240 | 7,056,040 | 6,942,334 |
| 11/706,300 | 11/740,265 | 11/737,720 | 11/739,056 | 11/740,204 | 11/740,223 | 11/753,557 |
| 11/750,285 | 11/758,648 | 11/778,559 | 11/834,634 | 11/838,878 | 11/845,669 | 6,799,853 |
| 7,237,896 | 6,749,301 | 10/451,722 | 7,137,678 | 7,252,379 | 7,144,107 | 10/503,900 |
| 10/503,898 | 10/503,897 | 7,220,068 | 7,270,410 | 7,241,005 | 7,108,437 | 7,140,792 |
| 10/503,922 | 7,224,274 | 10/503,917 | 10/503,918 | 10/503,925 | 10/503,927 | 10/503,928 |
| 10/503,929 | 10/503,885 | 7,195,325 | 7,229,164 | 7,150,523 | 10/503,889 | 7,154,580 |
| 6,906,778 | 7,167,158 | 7,128,269 | 6,688,528 | 6,986,613 | 6,641,315 | 7,278,702 |
| 10/503,891 | 7,150,524 | 7,155,395 | 6,915,140 | 6,999,206 | 6,795,651 | 6,883,910 |
| 7,118,481 | 7,136,198 | 7,092,130 | 6,786,661 | 6,808,325 | 10/920,368 | 10/920,284 |
| 7,219,990 | 10/920,283 | 6,750,901 | 6,476,863 | 6,788,336 | 6,322,181 | 6,597,817 |
| 6,227,648 | 6,727,948 | 6,690,419 | 10/470,947 | 6,619,654 | 6,969,145 | 6,679,582 |
| 10/470,942 | 6,568,670 | 6,866,373 | 7,280,247 | 7,008,044 | 6,742,871 | 6,966,628 |
| 6,644,781 | 6,969,143 | 6,767,076 | 6,834,933 | 6,692,113 | 6,913,344 | 6,727,951 |
| 7,128,395 | 7,036,911 | 7,032,995 | 6,969,151 | 6,955,424 | 6,969,162 | 10/919,249 |
| 6,942,315 | 11/006,577 | 7,234,797 | 6,986,563 | 7,295,211 | 11/045,442 | 7,286,162 |
| 7,283,159 | 7,077,330 | 6,196,541 | 11/149,389 | 11/185,725 | 7,226,144 | 11/202,344 |
| 7,267,428 | 11/248,423 | 11/248,422 | 7,093,929 | 11/282,769 | 11/330,060 | 11/442,111 |
| 7,290,862 | 11/499,806 | 11/499,710 | 6,195,150 | 11/749,156 | 11/782,588 | 11/854,435 |
| 11/853,817 | 11/935,958 | 11/924,608 | 6,362,868 | 11/970,993 | 6,831,681 | 6,431,669 |
| 6,362,869 | 6,472,052 | 6,356,715 | 6,894,694 | 6,636,216 | 6,366,693 | 6,329,990 |
| 6,459,495 | 6,137,500 | 6,690,416 | 7,050,143 | 6,398,328 | 7,110,024 | 6,431,704 |
| 6,879,341 | 6,415,054 | 6,665,454 | 6,542,645 | 6,486,886 | 6,381,361 | 6,317,192 |
| 6,850,274 | 09/113,054 | 6,646,757 | 6,624,848 | 6,357,135 | 6,271,931 | 6,353,772 |
| 6,106,147 | 6,665,008 | 6,304,291 | 6,305,770 | 6,289,262 | 6,315,200 | 6,217,165 |
| 6,496,654 | 6,859,225 | 6,924,835 | 6,647,369 | 6,943,830 | 09/693,317 | 7,021,745 |
| 6,712,453 | 6,460,971 | 6,428,147 | 6,416,170 | 6,402,300 | 6,464,340 | 6,612,687 |
| 6,412,912 | 6,447,099 | 6,837,567 | 6,505,913 | 7,128,845 | 6,733,684 | 7,249,108 |
| 6,566,858 | 6,331,946 | 6,246,970 | 6,442,525 | 09/517,384 | 09/505,951 | 6,374,354 |
| 7,246,098 | 6,816,968 | 6,757,832 | 6,334,190 | 6,745,331 | 7,249,109 | 10/203,559 |
| 7,197,642 | 7,093,139 | 10/636,263 | 10/636,283 | 10/866,608 | 7,210,038 | 10/902,883 |
| 10/940,653 | 10/942,858 | 11/706,329 | 11/757,385 | 11/758,642 | 7,119,836 | 7,283,162 |
| 7,286,169 | 10/636,285 | 7,170,652 | 6,967,750 | 6,995,876 | 7,099,051 | 7,172,191 |
| 7,243,916 | 7,222,845 | 11/239,232 | 7,285,227 | 7,063,940 | 11/107,942 | 7,193,734 |
| 7,086,724 | 7,090,337 | 7,278,723 | 7,140,717 | 11/190,902 | 11/209,711 | 7,256,824 |
| 7,140,726 | 7,156,512 | 7,186,499 | 11/478,585 | 11/525,862 | 11/540,574 | 11/583,875 |
| 11/592,181 | 6,750,944 | 11/599,336 | 7,291,447 | 11/744,183 | 11/758,646 | 11/778,561 |
| 11/839,532 | 11/838,874 | 11/853,021 | 11/869,710 | 11/868,531 | 11/927,403 | 11/951,960 |
| 10/636,225 | 6,985,207 | 6,773,874 | 6,650,836 | 10/666,495 | 10/636,224 | 7,250,975 |
| 7,295,343 | 6,880,929 | 7,236,188 | 7,236,187 | 7,155,394 | 10/636,219 | 10/636,223 |
| 7,055,927 | 6,986,562 | 7,052,103 | 7,312,845 | 10/656,281 | 10/656,791 | 10/666,124 |
| 10/683,217 | 7,289,142 | 7,095,533 | 6,914,686 | 6,896,252 | 6,820,871 | 6,834,851 |
| 6,848,686 | 6,830,246 | 6,851,671 | 10/729,098 | 7,092,011 | 7,187,404 | 10/729,159 |
| 10/753,458 | 6,878,299 | 6,929,348 | 6,921,154 | 10/780,625 | 10/804,042 | 6,913,346 |
| 10/831,238 | 10/831,237 | 10/831,239 | 10/831,240 | 10/831,241 | 10/831,234 | 10/831,233 |
| 7,246,897 | 7,077,515 | 10/831,235 | 10/853,336 | 10/853,117 | 10/853,659 | 10/853,681 |
| 6,913,875 | 7,021,758 | 7,033,017 | 7,161,709 | 7,099,033 | 7,147,294 | 7,156,494 |

-continued

| | | | | | | |
|---|---|---|---|---|---|---|
| 11/012,024 | 11/011,925 | 7,032,998 | 7,044,585 | 7,296,867 | 6,994,424 | 11/006,787 |
| 7,258,435 | 7,097,263 | 7,001,012 | 7,004,568 | 7,040,738 | 7,188,933 | 7,027,080 |
| 7,025,446 | 6,991,321 | 7,131,715 | 7,261,392 | 7,207,647 | 7,182,435 | 7,097,285 |
| 11/228,410 | 7,097,284 | 7,083,264 | 7,147,304 | 7,232,203 | 7,156,498 | 7,201,471 |
| 11/501,772 | 11/503,084 | 11/513,073 | 7,210,764 | 11/635,524 | 11/706,379 | 11/730,386 |
| 11/730,784 | 11/753,568 | 11/782,591 | 11/859,783 | 6,710,457 | 6,775,906 | 6,507,099 |
| 7,221,043 | 7,107,674 | 7,154,172 | 11/442,400 | 7,247,941 | 11/736,540 | 7,307,354 |
| 11/940,304 | 6,530,339 | 6,631,897 | 6,851,667 | 6,830,243 | 6,860,479 | 6,997,452 |
| 7,000,913 | 7,204,482 | 11/212,759 | 11/281,679 | 11/730,409 | 6,238,044 | 6,425,661 |
| 11/003,786 | 7,258,417 | 7,293,853 | 11/003,334 | 7,270,395 | 11/003,404 | 11/003,419 |
| 11/003,700 | 7,255,419 | 7,284,819 | 7,229,148 | 7,258,416 | 7,273,263 | 7,270,393 |
| 6,984,017 | 11/003,699 | 11/071,473 | 7,156,497 | 11/601,670 | 11/748,482 | 11/778,563 |
| 11/779,851 | 11/778,574 | 11/853,816 | 11/853,814 | 11/853,786 | 11/872,037 | 11/856,694 |
| 11/965,703 | 11/971,170 | 11/003,463 | 11/003,701 | 11/003,683 | 11/003,614 | 7,284,820 |
| 11/003,684 | 7,246,875 | 11/003,617 | 11/764,760 | 11/853,777 | 11/955,354 | 11/293,800 |
| 11/293,802 | 11/293,801 | 11/293,808 | 11/293,809 | 11/482,975 | 11/482,970 | 11/482,968 |
| 11/482,972 | 11/482,971 | 11/482,969 | 6,431,777 | 6,334,664 | 6,447,113 | 7,239,407 |
| 6,398,359 | 6,652,089 | 6,652,090 | 7,057,759 | 6,631,986 | 7,187,470 | 7,280,235 |
| 11/501,775 | 11/744,210 | 11/859,784 | 6,471,331 | 6,676,250 | 6,347,864 | 6,439,704 |
| 6,425,700 | 6,588,952 | 6,626,515 | 6,722,758 | 6,871,937 | 11/060,803 | 11/097,266 |
| 11/097,267 | 11/685,084 | 11/685,086 | 11/685,090 | 11/740,925 | 11/763,444 | 11/763,443 |
| 11/946,840 | 11/961,712 | 7,249,942 | 7,206,654 | 7,162,324 | 7,162,325 | 7,231,275 |
| 7,146,236 | 7,278,847 | 10/753,499 | 6,997,698 | 7,220,112 | 7,231,276 | 10/753,440 |
| 7,220,115 | 7,195,475 | 7,144,242 | 7,306,323 | 7,306,319 | 11/525,858 | 11/545,501 |
| 11/599,335 | 11/706,380 | 11/736,545 | 11/736,554 | 11/739,047 | 11/749,159 | 11/739,073 |
| 11/775,160 | 11/853,755 | 11/940,291 | 11/934,071 | 11/951,913 | 6,786,420 | 6,827,282 |
| 6,948,661 | 7,073,713 | 10/983,060 | 7,093,762 | 7,083,108 | 7,222,799 | 7,201,319 |
| 11/442,103 | 11/739,071 | 11/518,238 | 11/518,280 | 11/518,244 | 11/518,243 | 11/518,242 |
| 7,032,899 | 6,854,724 | 11/084,237 | 11/084,240 | 11/084,238 | 11/357,296 | 11/357,298 |
| 11/357,297 | 6,350,023 | 6,318,849 | 6,592,207 | 6,439,699 | 6,312,114 | 11/246,676 |
| 11/246,677 | 11/246,678 | 11/246,679 | 11/246,680 | 11/246,681 | 11/246,714 | 11/246,713 |
| 11/246,689 | 11/246,671 | 11/246,670 | 11/246,669 | 11/246,704 | 11/246,710 | 11/246,688 |
| 11/246,716 | 11/246,715 | 11/246,707 | 11/246,706 | 11/246,705 | 11/246,708 | 11/246,693 |
| 11/246,692 | 11/246,696 | 11/246,695 | 11/246,694 | 11/482,958 | 11/482,955 | 11/482,962 |
| 11/482,963 | 11/482,956 | 11/482,954 | 11/482,974 | 11/482,957 | 11/482,987 | 11/482,959 |
| 11/482,960 | 11/482,961 | 11/482,964 | 11/482,965 | 11/482,976 | 11/482,973 | 11/495,815 |
| 11/495,816 | 11/495,817 | 60/992,635 | 60/992,637 | 60/992,641 | 10/803,074 | 10/803,073 |
| 7,040,823 | 10/803,076 | 10/803,077 | 10/803,078 | 10/803,079 | 10/922,971 | 10/922,970 |
| 10/922,836 | 10/922,842 | 10/922,848 | 10/922,843 | 7,125,185 | 7,229,226 | 11/513,386 |
| 11/753,559 | 10/815,621 | 7,243,835 | 10/815,630 | 10/815,637 | 10/815,638 | 7,251,050 |
| 10/815,642 | 7,097,094 | 7,137,549 | 10/815,618 | 7,156,292 | 11/738,974 | 10/815,635 |
| 10/815,647 | 10/815,634 | 7,137,566 | 7,131,596 | 7,128,265 | 7,207,485 | 7,197,374 |
| 7,175,089 | 10/815,617 | 10/815,620 | 7,178,719 | 10/815,613 | 7,207,483 | 7,296,737 |
| 7,270,266 | 10/815,614 | 11/446,240 | 11/488,162 | 11/488,163 | 11/488,164 | 11/488,167 |
| 11/488,168 | 11/488,165 | 11/488,166 | 7,267,273 | 11/834,628 | 11/839,497 | 11/944,449 |
| 10/815,636 | 7,128,270 | 11/041,650 | 11/041,651 | 11/041,652 | 11/041,649 | 11/041,610 |
| 11/863,253 | 11/863,255 | 11/863,257 | 11/863,258 | 11/863,262 | 11/041,609 | 11/041,626 |
| 11/041,627 | 11/041,624 | 11/041,625 | 11/863,268 | 11/863,269 | 11/863,270 | 11/863,271 |
| 11/863,273 | 76/584,733 | 11/041,556 | 11/041,580 | 11/041,723 | 11/041,698 | 11/041,648 |
| 11/863,263 | 11/863,264 | 11/863,265 | 11/863,266 | 11/863,267 | 10/815,609 | 7,150,398 |
| 7,159,777 | 10/815,610 | 7,188,769 | 7,097,106 | 7,070,110 | 7,243,849 | 11/442,381 |
| 11/480,957 | 11/764,694 | 11/957,470 | 6,227,652 | 6,213,588 | 6,213,589 | 6,231,163 |
| 6,247,795 | 6,394,581 | 6,244,691 | 6,257,704 | 6,416,168 | 6,220,694 | 6,257,705 |
| 6,247,794 | 6,234,610 | 6,247,793 | 6,264,306 | 6,241,342 | 6,247,792 | 6,264,307 |
| 6,254,220 | 6,234,611 | 6,302,528 | 6,283,582 | 6,239,821 | 6,338,547 | 6,247,796 |
| 6,557,977 | 6,390,603 | 6,362,843 | 6,293,653 | 6,312,107 | 6,227,653 | 6,234,609 |
| 6,238,040 | 6,188,415 | 6,227,654 | 6,209,989 | 6,247,791 | 6,336,710 | 6,217,153 |
| 6,416,167 | 6,243,113 | 6,283,581 | 6,247,790 | 6,260,953 | 6,267,469 | 6,588,882 |
| 6,742,873 | 6,918,655 | 6,547,371 | 6,938,989 | 6,598,964 | 6,923,526 | 6,273,544 |
| 6,309,048 | 6,420,196 | 6,443,558 | 6,439,689 | 6,378,989 | 6,848,181 | 6,634,735 |
| 6,299,289 | 6,299,290 | 6,425,654 | 6,902,255 | 6,623,101 | 6,406,129 | 6,505,916 |
| 6,457,809 | 6,550,895 | 6,457,812 | 7,152,962 | 6,428,133 | 7,216,956 | 7,080,895 |
| 11/144,844 | 7,182,437 | 11/599,341 | 11/635,533 | 11/607,976 | 11/607,975 | 11/607,999 |
| 11/607,980 | 11/607,979 | 11/607,978 | 11/735,961 | 11/685,074 | 11/696,126 | 11/696,144 |
| 11/696,650 | 11/763,446 | 6,224,780 | 6,235,212 | 6,280,643 | 6,284,147 | 6,214,244 |
| 6,071,750 | 6,267,905 | 6,251,298 | 6,258,285 | 6,225,138 | 6,241,904 | 6,299,786 |
| 6,866,789 | 6,231,773 | 6,190,931 | 6,248,249 | 6,290,862 | 6,241,906 | 6,565,762 |
| 6,241,905 | 6,451,216 | 6,231,772 | 6,274,056 | 6,290,861 | 6,248,248 | 6,306,671 |
| 6,331,258 | 6,110,754 | 6,294,101 | 6,416,679 | 6,264,849 | 6,254,793 | 6,245,246 |
| 6,855,264 | 6,235,211 | 6,491,833 | 6,264,850 | 6,258,284 | 6,312,615 | 6,228,668 |
| 6,180,427 | 6,171,875 | 6,267,904 | 6,245,247 | 6,315,914 | 7,169,316 | 6,526,658 |
| 7,210,767 | 11/056,146 | 11/635,523 | 6,665,094 | 6,450,605 | 6,512,596 | 6,654,144 |
| 7,125,090 | 6,687,022 | 7,072,076 | 7,092,125 | 7,215,443 | 7,136,195 | 7,077,494 |
| 6,877,834 | 6,969,139 | 10/636,227 | 7,283,280 | 6,912,067 | 7,277,205 | 7,154,637 |
| 10/636,230 | 7,070,251 | 6,851,782 | 10/636,211 | 10/636,247 | 6,843,545 | 7,079,286 |
| 7,064,867 | 7,065,247 | 7,027,177 | 7,218,415 | 7,064,873 | 6,954,276 | 7,061,644 |
| 7,092,127 | 7,059,695 | 10/990,382 | 7,177,052 | 7,270,394 | 11/124,231 | 7,188,921 |
| 7,187,469 | 7,196,820 | 11/281,445 | 7,283,281 | 7,251,051 | 7,245,399 | 11/524,911 |
| 11/640,267 | 11/706,297 | 11/730,387 | 11/737,142 | 11/764,729 | 11/834,637 | 11/853,019 |

-continued

| | | | | | | |
|---|---|---|---|---|---|---|
| 11/863,239 | 11/305,274 | 11/305,273 | 11/305,275 | 11/305,152 | 11/305,158 | 11/305,008 |
| 6,231,148 | 6,293,658 | 6,614,560 | 6,238,033 | 6,312,070 | 6,238,111 | 6,378,970 |
| 6,196,739 | 6,270,182 | 6,152,619 | 7,006,143 | 6,876,394 | 6,738,096 | 6,970,186 |
| 6,287,028 | 6,412,993 | 11/033,145 | 11/102,845 | 11/102,861 | 11/248,421 | 11/672,878 |
| 7,204,941 | 7,282,164 | 10/815,628 | 11/845,672 | 7,278,727 | 10/913,373 | 10/913,374 |
| 10/913,372 | 7,138,391 | 7,153,956 | 10/913,380 | 10/913,379 | 10/913,376 | 7,122,076 |
| 7,148,345 | 11/172,816 | 11/172,815 | 11/172,814 | 11/482,990 | 11/482,986 | 11/482,985 |
| 11/454,899 | 11/583,942 | 11/592,990 | 11/849,360 | 11/831,961 | 11/831,962 | 11/831,963 |
| 60/951,700 | 11/832,629 | 11/832,637 | 60/971,535 | 10/407,212 | 7,252,366 | 10/683,064 |
| 10/683,041 | 7,275,811 | 10/884,889 | 10/922,890 | 10/922,875 | 10/922,885 | 10/922,889 |
| 10/922,884 | 10/922,879 | 10/922,887 | 10/922,888 | 10/922,874 | 7,234,795 | 10/922,871 |
| 10/922,880 | 7,293,855 | 10/922,882 | 10/922,883 | 10/922,878 | 10/922,872 | 10/922,876 |
| 10/922,886 | 10/922,877 | 7,147,792 | 7,175,774 | 11/159,193 | 11/491,378 | 11/766,713 |
| 11/841,647 | 11/482,980 | 11/563,684 | 11/482,967 | 11/482,966 | 11/482,988 | 11/482,989 |
| 11/293,832 | 11/293,838 | 11/293,825 | 11/293,841 | 11/293,799 | 11/293,796 | 11/293,797 |
| 11/293,798 | 11/124,158 | 11/124,196 | 11/124,199 | 11/124,162 | 11/124,202 | 11/124,197 |
| 11/124,154 | 11/124,198 | 7,284,921 | 11/124,151 | 11/124,160 | 11/124,192 | 11/124,175 |
| 11/124,163 | 11/124,149 | 11/124,152 | 11/124,173 | 11/124,155 | 7,236,271 | 11/124,174 |
| 11/124,194 | 11/124,164 | 11/124,200 | 11/124,195 | 11/124,166 | 11/124,150 | 11/124,172 |
| 11/124,165 | 11/124,186 | 11/124,185 | 11/124,184 | 11/124,182 | 11/124,201 | 11/124,171 |
| 11/124,181 | 11/124,161 | 11/124,156 | 11/124,191 | 11/124,159 | 11/124,176 | 11/124,188 |
| 11/124,170 | 11/124,187 | 11/124,189 | 11/124,190 | 11/124,180 | 11/124,193 | 11/124,183 |
| 11/124,178 | 11/124,177 | 11/124,148 | 11/124,168 | 11/124,167 | 11/124,179 | 11/124,169 |
| 11/187,976 | 11/188,011 | 11/188,014 | 11/482,979 | 11/735,490 | 11/853,018 | 11/944,450 |
| 11/228,540 | 11/228,500 | 11/228,501 | 11/228,530 | 11/228,490 | 11/228,531 | 11/228,504 |
| 11/228,533 | 11/228,502 | 11/228,507 | 11/228,482 | 11/228,505 | 11/228,497 | 11/228,487 |
| 11/228,529 | 11/228,484 | 11/228,489 | 11/228,518 | 11/228,536 | 11/228,496 | 11/228,488 |
| 11/228,506 | 11/228,516 | 11/228,526 | 11/228,539 | 11/228,538 | 11/228,524 | 11/228,523 |
| 11/228,519 | 11/228,528 | 11/228,527 | 11/228,525 | 11/228,520 | 11/228,498 | 11/228,511 |
| 11/228,522 | 11/228,515 | 11/228,537 | 11/228,534 | 11/228,491 | 11/228,499 | 11/228,509 |
| 11/228,492 | 11/228,493 | 11/228,510 | 11/228,508 | 11/228,512 | 11/228,514 | 11/228,494 |
| 11/228,495 | 11/228,486 | 11/228,481 | 11/228,477 | 11/228,485 | 11/228,483 | 11/228,521 |
| 11/228,517 | 11/228,532 | 11/228,513 | 11/228,503 | 11/228,480 | 11/228,535 | 11/228,478 |
| 11/228,479 | 6,238,115 | 6,386,535 | 6,398,344 | 6,612,240 | 6,752,549 | 6,805,049 |
| 6,971,313 | 6,899,480 | 6,860,664 | 6,925,935 | 6,966,636 | 7,024,995 | 7,284,852 |
| 6,926,455 | 7,056,038 | 6,869,172 | 7,021,843 | 6,988,845 | 6,964,533 | 6,981,809 |
| 7,284,822 | 7,258,067 | 11/155,544 | 7,222,941 | 7,284,925 | 7,278,795 | 7,249,904 |
| 11/737,726 | 11/772,240 | 11/863,246 | 11/863,145 | 11/865,650 | 6,087,638 | 6,340,222 |
| 6,041,600 | 6,299,300 | 6,067,797 | 6,286,935 | 6,044,646 | 6,382,769 | 6,787,051 |
| 6,938,990 | 11/242,916 | 11/144,799 | 11/198,235 | 11/861,282 | 11861284 | 11/766,052 |
| 7,152,972 | 11/592,996 | D529952 | 6,390,605 | 6,322,195 | 6,612,110 | 6,480,089 |
| 6,460,778 | 6,305,788 | 6,426,014 | 6,364,453 | 6,457,795 | 6,315,399 | 6,338,548 |
| 7,040,736 | 6,938,992 | 6,994,425 | 6,863,379 | 6,540,319 | 6,994,421 | 6,984,019 |
| 7,008,043 | 6,997,544 | 6,328,431 | 6,991,310 | 10/965,772 | 7,140,723 | 6,328,425 |
| 6,982,184 | 7,267,423 | 7,134,741 | 7,066,577 | 7,152,945 | 11/038,200 | 7,021,744 |
| 6,991,320 | 7,155,911 | 11/107,799 | 6,595,624 | 7,152,943 | 7,125,103 | 11/209,709 |
| 7,290,857 | 7,285,437 | 7,229,151 | 11/330,058 | 7,237,873 | 11/329,163 | 11/442,180 |
| 11/450,431 | 7,213,907 | 6,417,757 | 11/482,951 | 11/545,566 | 11/583,826 | 11/604,315 |
| 11/604,323 | 11/643,845 | 11/706,950 | 11/730,399 | 11/749,121 | 11/753,549 | 11/834,630 |
| 11/935,389 | 11/869,670 | 7,095,309 | 11/945,157 | 11/957,473 | 11/967,235 | 6,854,825 |
| 6,623,106 | 6,672,707 | 6,575,561 | 6,817,700 | 6,588,885 | 7,075,677 | 6,428,139 |
| 6,575,549 | 6,846,692 | 6,425,971 | 7,063,993 | 6,383,833 | 6,955,414 | 6,412,908 |
| 6,746,105 | 6,953,236 | 6,412,904 | 7,128,388 | 6,398,343 | 6,652,071 | 6,793,323 |
| 6,659,590 | 6,676,245 | 7,201,460 | 6,464,332 | 6,659,593 | 6,478,406 | 6,978,613 |
| 6,439,693 | 6,502,306 | 6,966,111 | 6,863,369 | 6,428,142 | 6,874,868 | 6,390,591 |
| 6,799,828 | 6,896,358 | 7,018,016 | 10/296,534 | 6,328,417 | 6,322,194 | 6,382,779 |
| 6,629,745 | 6,565,193 | 6,609,786 | 6,609,787 | 6,439,908 | 6,684,503 | 6,843,551 |
| 6,764,166 | 6,561,617 | 10/510,092 | 6,557,970 | 6,546,628 | 10/510,098 | 6,652,074 |
| 6,820,968 | 7,175,260 | 6,682,174 | 7,303,262 | 6,648,453 | 6,834,932 | 6,682,176 |
| 6,998,062 | 6,767,077 | 7,278,717 | 6,755,509 | 10/534,813 | 6,692,108 | 10/534,811 |
| 6,672,709 | 7,303,263 | 7,086,718 | 10/534,881 | 6,672,710 | 10/534,812 | 6,669,334 |
| 10/534,804 | 7,152,958 | 7,28,1782 | 6,824,246 | 7,264,336 | 6,669,333 | 10/534,815 |
| 6,820,967 | 7,306,326 | 6,736,489 | 7,264,335 | 6,719,406 | 7,222,943 | 7,188,419 |
| 7,168,166 | 6,974,209 | 7,086,719 | 6,974,210 | 7,195,338 | 7,252,775 | 7,101,025 |
| 11/474,281 | 11/485,258 | 11/706,304 | 11/706,324 | 11/706,326 | 11/706,321 | 11/772,239 |
| 11/782,598 | 11/829,941 | 11/852,991 | 11/852,986 | 11/936,062 | 11/934,027 | 11/955,028 |
| 11/763,440 | 11/763,442 | 11/246,687 | 11/246,718 | 11/246,685 | 11/246,686 | 11/246,703 |
| 11/246,691 | 11/246,711 | 11/246,690 | 11/246,712 | 11/246,717 | 11/246,709 | 11/246,700 |
| 11/246,701 | 11/246,702 | 11/246,668 | 11/246,697 | 11/246,698 | 11/246,699 | 11/246,675 |
| 11/246,674 | 11/246,667 | 11/829,957 | 11/829,960 | 11/829,961 | 11/829,962 | 11/829,963 |
| 11/829,966 | 11/829,967 | 11/829,968 | 11/829,969 | 11/946,839 | 11/946,838 | 11/946,837 |
| 11/951,230 | 7,156,508 | 7,159,972 | 7,083,271 | 7,165,834 | 7,080,894 | 7,201,469 |
| 7,090,336 | 7,156,489 | 10/760,233 | 10/760,246 | 7,083,257 | 7,258,422 | 7,255,423 |
| 7,219,980 | 10/760,253 | 10/760,255 | 10/760,209 | 7,118,192 | 10/760,194 | 10/760,238 |
| 7,077,505 | 7,198,354 | 7,077,504 | 10/760,189 | 7,198,355 | 10/760,232 | 10/760,231 |
| 7,152,959 | 7,213,906 | 7,178,901 | 7,222,938 | 7,108,353 | 7,104,629 | 11/446,227 |
| 11/454,904 | 11/472,345 | 11/474,273 | 7,261,401 | 11/474,279 | 11/482,939 | 11/482,950 |
| 11/499,709 | 7,306,324 | 7,306,325 | 11/603,824 | 11/601,756 | 11/601,672 | 7,303,261 |
| 11/653,253 | 11/706,328 | 11/706,299 | 11/706,965 | 11/737,080 | 11/737,041 | 11/778,062 |

-continued

| | | | | | | |
|---|---|---|---|---|---|---|
| 11/778,566 | 11/782,593 | 11/934,018 | 11/945,157 | 11/951,095 | 11/951,828 | 11/954,906 |
| 11/954,949 | 11/967,226 | 7,303,930 | 11/246,672 | 11/246,673 | 11/246,683 | 11/246,682 |
| 60/939,086 | 11/860,538 | 11/860,539 | 11/860,540 | 11/860,541 | 11/860,542 | 11/936,060 |
| 11/877,667 | 11/877,668 | 7,246,886 | 7,128,400 | 7,108,355 | 6,991,322 | 7,287,836 |
| 7,118,197 | 10/728,784 | 10/728,783 | 7,077,493 | 6,962,402 | 10/728,803 | 7,147,308 |
| 10/728,779 | 7,118,198 | 7,168,790 | 7,172,270 | 7,229,155 | 6,830,318 | 7,195,342 |
| 7,175,261 | 10/773,183 | 7,108,356 | 7,118,202 | 10/773,186 | 7,134,744 | 10/773,185 |
| 7,134,743 | 7,182,439 | 7,210,768 | 10/773,187 | 7,134,745 | 7,156,484 | 7,118,201 |
| 7,111,926 | 10/773,184 | 7,018,021 | 11/060,751 | 11/060,805 | 11/188,017 | 7,128,402 |
| 11/298,774 | 11/329,157 | 11/490,041 | 11/501,767 | 7,284,839 | 7,246,885 | 7,229,156 |
| 11/505,846 | 11/505,857 | 7,293,858 | 11/524,908 | 11/524,938 | 7,258,427 | 11/524,912 |
| 7,278,716 | 11/592,995 | 11/603,825 | 11/649,773 | 11/650,549 | 11/653,237 | 11/706,378 |
| 11/706,962 | 11/749,118 | 11/754,937 | 11/749,120 | 11/744,885 | 11/779,850 | 11/765,439 |
| 11/842,950 | 11/839,539 | 11/926,121 | 11/097,308 | 11/097,309 | 7,246,876 | 11/097,299 |
| 11/097,310 | 11/097,213 | 11/210,687 | 11/097,212 | 7,147,306 | 7,261,394 | 11/764,806 |
| 11/782,595 | 11/965,696 | 11/482,953 | 11/482,977 | 11/544,778 | 11/544,779 | 11/764,808 |
| 11/756,624 | 11/756,625 | 11/756,626 | 11/756,627 | 11/756,628 | 11/756,629 | 11/756,630 |
| 11/756,631 | 7,156,289 | 7,178,718 | 7,225,979 | 11/712,434 | 11/084,796 | 11/084,742 |
| 11/084,806 | 09/575,197 | 09/575,197 | 7,079,712 | 7,079,712 | 6,825,945 | 6,825,945 |
| 09/575,165 | 09/575,165 | 6,813,039 | 6,813,039 | 7,190,474 | 7,190,474 | 6,987,506 |
| 6,987,506 | 6,824,044 | 6,824,044 | 7,038,797 | 7,038,797 | 6,980,318 | 6,980,318 |
| 6,816,274 | 6,816,274 | 7,102,772 | 7,102,772 | 09/575,186 | 09/575,186 | 6,681,045 |
| 6,681,045 | 6,678,499 | 6,678,499 | 6,679,420 | 6,679,420 | 6,963,845 | 6,963,845 |
| 6,976,220 | 6,976,220 | 6,728,000 | 6,728,000 | 7,110,126 | 7,110,126 | 7,173,722 |
| 7,173,722 | 6,976,035 | 6,976,035 | 6,813,558 | 6,813,558 | 6,766,942 | 6,766,942 |
| 6,965,454 | 6,965,454 | 6,995,859 | 6,995,859 | 7,088,459 | 7,088,459 | 6,720,985 |
| 6,720,985 | 7,286,113 | 7,286,113 | 6,922,779 | 6,922,779 | 6,978,019 | 6,978,019 |
| 6,847,883 | 6,847,883 | 7,131,058 | 7,131,058 | 7,295,839 | 7,295,839 | 09/607,843 |
| 09/607,843 | 09/693,690 | 09/693,690 | 6,959,298 | 6,959,298 | 6,973,450 | 6,973,450 |
| 7,150,404 | 7,150,404 | 6,965,882 | 6,965,882 | 7,233,924 | 7,233,924 | 09/575,181 |
| 09/575,181 | 09/722,174 | 09/722,174 | 7,175,079 | 7,175,079 | 7,162,259 | 6,718,061 |
| 10/291,523 | 10/291,471 | 7,012,710 | 6,825,956 | 10/291,481 | 7,222,098 | 10/291,825 |
| 7,263,508 | 7,031,010 | 6,972,864 | 6,862,105 | 7,009,738 | 6,989,911 | 6,982,807 |
| 10/291,576 | 6,829,387 | 6,714,678 | 6,644,545 | 6,609,653 | 6,651,879 | 10/291,555 |
| 7,293,240 | 10/291,592 | 10/291,542 | 7,044,363 | 7,004,390 | 6,867,880 | 7,034,953 |
| 6,987,581 | 7,216,224 | 10/291,821 | 7,162,269 | 7,162,222 | 7,290,210 | 7,293,233 |
| 7,293,234 | 6,850,931 | 6,865,570 | 6,847,961 | 10/685,523 | 10/685,583 | 7,162,442 |
| 10/685,584 | 7,159,784 | 10/804,034 | 10/793,933 | 6,889,896 | 10/831,232 | 7,174,056 |
| 6,996,274 | 7,162,088 | 10/943,874 | 10/943,872 | 10/944,044 | 7,259,884 | 10/944,043 |
| 7,167,270 | 10/943,877 | 6,986,459 | 10/954,170 | 7,181,448 | 10/981,626 | 10/981,616 |
| 10/981,627 | 7,231,293 | 7,174,329 | 10/992,713 | 7,295,922 | 7,200,591 | 11/020,106 |
| 11/020,260 | 11/020,321 | 11/020,319 | 11/026,045 | 11/059,696 | 11/051,032 | 11/059,674 |
| 11/107,944 | 11/107,941 | 11/082,940 | 11/082,815 | 11/082,827 | 11/082,829 | 6,991,153 |
| 6,991,154 | 11/124,256 | 11/123,136 | 11/154,676 | 11/159,196 | 11/182,002 | 11/202,251 |
| 11/202,252 | 11/202,253 | 11/203,200 | 11/202,218 | 11/206,778 | 11/203,424 | 11/222,977 |
| 11/228,450 | 11/227,239 | 11/286,334 | 7,225,402 | 11/329,187 | 11/349,143 | 11/491,225 |
| 11/491,121 | 11/442,428 | 11/454,902 | 11/442,385 | 11/478,590 | 7,271,931 | 11/520,170 |
| 11/603,057 | 11/706,964 | 11/739,032 | 11/739,014 | 11/834,633 | 11/830,848 | 11/830,849 |
| 11/839,542 | 11/866,394 | 11/934,077 | 11/951,874 | 7,068,382 | 7,068,382 | 7,007,851 |
| 7,007,851 | 6,957,921 | 6,957,921 | 6,457,883 | 6,457,883 | 10/743,671 | 7,044,381 |
| 11/203,205 | 7,094,910 | 7,091,344 | 7,122,685 | 7,038,066 | 7,099,019 | 7,062,651 |
| 7,062,651 | 6,789,194 | 6,789,194 | 6,789,191 | 6,789,191 | 10/900,129 | 7,278,018 |
| 10/913,350 | 10/982,975 | 10/983,029 | 11/331,109 | 6,644,642 | 6,644,642 | 6,502,614 |
| 6,502,614 | 6,622,999 | 6,622,999 | 6,669,385 | 6,669,385 | 6,827,116 | 7,011,128 |
| 10/949,307 | 6,549,935 | 6,549,935 | 6,987,573 | 6,987,573 | 6,727,996 | 6,727,996 |
| 6,591,884 | 6,591,884 | 6,439,706 | 6,439,706 | 6,760,119 | 6,760,119 | 7,295,332 |
| 7,295,332 | 7,064,851 | 7,064,851 | 6,826,547 | 6,826,547 | 6,290,349 | 6,290,349 |
| 6,428,155 | 6,428,155 | 6,785,016 | 6,785,016 | 6,831,682 | 6,831,682 | 6,741,871 |
| 6,741,871 | 6,927,871 | 6,927,871 | 6,980,306 | 6,980,306 | 6,965,439 | 6,965,439 |
| 6,840,606 | 7,036,918 | 6,977,746 | 6,970,264 | 7,068,389 | 7,093,991 | 7,190,491 |
| 10/901,154 | 10/932,044 | 10/962,412 | 7,177,054 | 10/962,552 | 10/965,733 | 10/965,933 |
| 10/974,742 | 10/982,974 | 7,180,609 | 10/986,375 | 11/107,817 | 7,292,363 | 11/149,160 |
| 11/206,756 | 11/250,465 | 7,202,959 | 11/653,219 | 11/706,309 | 11/730,389 | 11/730,392 |
| 60/953,443 | 11/866,387 | 60/974,077 | 6,982,798 | 6,982,798 | 6,870,966 | 6,870,966 |
| 6,822,639 | 6,822,639 | 6,474,888 | 6,474,888 | 6,627,870 | 6,627,870 | 6,724,374 |
| 6,724,374 | 6,788,982 | 6,788,982 | 7,263,270 | 7,263,270 | 6,788,293 | 6,788,293 |
| 6,946,672 | 6,946,672 | 6,737,591 | 6,737,591 | 7,091,960 | 7,091,960 | 09/693,514 |
| 09/693,514 | 6,792,165 | 6,792,165 | 7,105,753 | 7,105,753 | 6,795,593 | 6,980,704 |
| 6,768,821 | 7,132,612 | 7,041,916 | 6,797,895 | 7,015,901 | 7,289,882 | 7,148,644 |
| 10/778,056 | 10/778,058 | 10/778,060 | 10/778,059 | 10/778,063 | 10/778,062 | 10/778,061 |
| 10/778,057 | 7,096,199 | 7,286,887 | 10/917,467 | 10/917,466 | 10/917,465 | 7,218,978 |
| 7,245,294 | 7,277,085 | 7,187,370 | 10/917,436 | 10/943,856 | 10/919,379 | 7,019,319 |
| 10/943,878 | 10/943,849 | 7,043,096 | 7,148,499 | 11/144,840 | 11/155,556 | 11/155,557 |
| 11/193,481 | 11/193,435 | 11/193,482 | 11/193,479 | 11/255,941 | 11/281,671 | 11/298,474 |
| 7,245,760 | 11/488,832 | 11/495,814 | 11/495,823 | 11/495,822 | 11/495,821 | 11/495,820 |
| 11/653,242 | 11/754,370 | 60/911,260 | 11/829,936 | 11/839,494 | 11/866,305 | 11/866,313 |
| 11/866,324 | 11/866,336 | 11/866,348 | 11/866,359 | 11/970,951 | 7,055,739 | 7,055,739 |
| 7,233,320 | 7,233,320 | 6,830,196 | 6,830,196 | 6,832,717 | 6,832,717 | 7,182,247 |
| 7,182,247 | 7,120,853 | 7,082,562 | 6,843,420 | 10/291,718 | 6,789,731 | 7,057,608 |

-continued

| | | | | | | |
|---|---|---|---|---|---|---|
| 6,766,944 | 6,766,945 | 7,289,103 | 10/291,559 | 7,299,969 | 7,264,173 | 10/409,864 |
| 7,108,192 | 10/537,159 | 7,111,791 | 7,077,333 | 6,983,878 | 10/786,631 | 7,134,598 |
| 10/893,372 | 6,929,186 | 6,994,264 | 7,017,826 | 7,014,123 | 7,134,601 | 7,150,396 |
| 10/971,146 | 7,017,823 | 7,025,276 | 7,284,701 | 7,080,780 | 11/074,802 | 11/442,366 |
| 11/749,158 | 11/842,948 | 10/492,169 | 10/492,152 | 10/492,168 | 10/492,161 | 7,308,148 |
| 10/502,575 | 10/531,229 | 10/683,151 | 10/531,733 | 10/683,040 | 10/510,391 | 10/919,260 |
| 10/510,392 | 10/778,090 | 11/944,404 | 11/936,638 | 6,957,768 | 6,957,768 | 09/575,172 |
| 09/575,172 | 7,170,499 | 7,170,499 | 7,106,888 | 7,106,888 | 7,123,239 | 7,123,239 |
| 6,982,701 | 6,982,703 | 7,227,527 | 6,786,397 | 6,947,027 | 6,975,299 | 7,139,431 |
| 7,048,178 | 7,118,025 | 6,839,053 | 7,015,900 | 7,010,147 | 7,133,557 | 6,914,593 |
| 10/291,546 | 6,938,826 | 7,278,566 | 7,123,245 | 6,992,662 | 7,190,346 | 11/074,800 |
| 11/074,782 | 11/074,777 | 11/075,917 | 7,221,781 | 11/102,843 | 7,213,756 | 11/188,016 |
| 7,180,507 | 7,263,225 | 7,287,688 | 11/737,094 | 11/753,570 | 11/782,596 | 11/865,711 |
| 11/856,061 | 11/856,062 | 11/856,064 | 11/856,066 | 11/672,522 | 11/672,950 | 11/672,947 |
| 11/672,891 | 11/672,954 | 11/672,533 | 11/754,310 | 11/754,321 | 11/754,320 | 11/754,319 |
| 11/754,318 | 11/754,317 | 11/754,316 | 11/754,315 | 11/754,314 | 11/754,313 | 11/754,312 |
| 11/754,311 | 6,593,166 | 6,593,166 | 7,132,679 | 6,940,088 | 7,119,357 | 7,307,272 |
| 6,755,513 | 6,974,204 | 6,409,323 | 7,055,930 | 6,281,912 | 6,893,109 | 6,604,810 |
| 6,824,242 | 6,318,920 | 7,210,867 | 6,488,422 | 6,655,786 | 6,457,810 | 6,485,135 |
| 6,796,731 | 6,904,678 | 6,641,253 | 7,125,106 | 6,786,658 | 7,097,273 | 6,824,245 |
| 7,222,947 | 6,918,649 | 6,860,581 | 6,929,351 | 7,063,404 | 6,969,150 | 7,004,652 |
| 6,871,938 | 6,905,194 | 6,846,059 | 6,997,626 | 10/974,881 | 7,029,098 | 6,966,625 |
| 7,114,794 | 7,207,646 | 7,077,496 | 7,284,831 | 11/072,529 | 7,152,938 | 7,182,434 |
| 7,182,430 | 7,306,317 | 7,032,993 | 11/155,513 | 11/155,545 | 11/144,813 | 7,172,266 |
| 7,258,430 | 7,128,392 | 7,210,866 | 7,306,322 | 11/505,933 | 11/540,727 | 11/635,480 |
| 11/707,946 | 11/706,303 | 11/709,084 | 11/730,776 | 11/744,143 | 11/779,845 | 11/782,589 |
| 11/863,256 | 11/940,302 | 11/940,235 | 11/955,359 | 11/066,161 | 11/066,160 | 11/066,159 |
| 11/066,158 | 7,287,831 | 11/875,936 | 6,804,030 | 6,807,315 | 6,771,811 | 6,683,996 |
| 7,271,936 | 7,304,771 | 6,965,691 | 7,058,219 | 7,289,681 | 7,187,807 | 7,181,063 |
| 11/338,783 | 11/603,823 | 11/650,536 | 10/727,181 | 10/727,162 | 10/727,163 | 10/727,245 |
| 7,121,639 | 7,165,824 | 7,152,942 | 10/727,157 | 7,181,572 | 7,096,137 | 7,302,592 |
| 7,278,034 | 7,188,282 | 10/727,159 | 10/727,180 | 10/727,179 | 10/727,192 | 10/727,274 |
| 10/727,164 | 10/727,161 | 10/727,198 | 10/727,158 | 10/754,536 | 10/754,938 | 10/727,227 |
| 10/727,160 | 10/934,720 | 7,171,323 | 7,278,697 | 11/442,131 | 11/474,278 | 11/488,853 |
| 11/488,841 | 11/749,750 | 11/749,749 | 11/955,127 | 11/951,213 | 10/296,522 | 6,795,215 |
| 7,070,098 | 7,154,638 | 6,805,419 | 6,859,289 | 6,977,751 | 6,398,332 | 6,394,573 |
| 6,622,923 | 6,747,760 | 6,921,144 | 10/884,881 | 7,092,112 | 7,192,106 | 11/039,866 |
| 7,173,739 | 6,986,560 | 7,008,033 | 11/148,237 | 7,222,780 | 7,270,391 | 7,150,510 |
| 11/478,599 | 11/499,749 | 11/521,388 | 11/738,518 | 11/482,981 | 11/743,662 | 11/743,661 |
| 11/743,659 | 11/743,655 | 11/743,657 | 11/752,900 | 11/926,109 | 11/927,163 | 11/929,567 |
| 7,195,328 | 7,182,422 | 11/650,537 | 11/712,540 | 10/854,521 | 10/854,522 | 10/854,488 |
| 7,281,330 | 10/854,503 | 10/854,504 | 10/854,509 | 7,188,928 | 7,093,989 | 10/854,497 |
| 10/854,495 | 10/854,498 | 10/854,511 | 10/854,512 | 10/854,525 | 10/854,526 | 10/854,516 |
| 7,252,353 | 10/854,515 | 7,267,417 | 10/854,505 | 10/854,493 | 7,275,805 | 7,314,261 |
| 10/854,490 | 7,281,777 | 7,290,852 | 10/854,528 | 10/854,523 | 10/854,527 | 10/854,524 |
| 10/854,520 | 10/854,514 | 10/854,519 | 10/854,513 | 10/854,499 | 10/854,501 | 7,266,661 |
| 7,243,193 | 10/854,518 | 10/854,517 | 10/934,628 | 7,163,345 | 11/499,803 | 11/601,757 |
| 11/706,295 | 11/735,881 | 11/748,483 | 11/749,123 | 11/766,061 | 11/775,135 | 11/772,235 |
| 11/778,569 | 11/829,942 | 11/870,342 | 11/935,274 | 11/937,239 | 11/961,907 | 11/961,940 |
| 11/961,961 | 11/014,731 | D529081 | D541848 | D528597 | 6,924,907 | 6,712,452 |
| 6,416,160 | 6,238,043 | 6,958,826 | 6,812,972 | 6,553,459 | 6,967,741 | 6,956,669 |
| 6,903,766 | 6,804,026 | 7,259,889 | 6,975,429 | 10/636,234 | 10/636,233 | 7,301,567 |
| 10/636,216 | 7,274,485 | 7,139,084 | 7,173,735 | 7,068,394 | 7,286,182 | 7,086,644 |
| 7,250,977 | 7,146,281 | 7,023,567 | 7,136,183 | 7,083,254 | 6,796,651 | 7,061,643 |
| 7,057,758 | 6,894,810 | 6,995,871 | 7,085,010 | 7,092,126 | 7,123,382 | 7,061,650 |
| 10/853,143 | 6,986,573 | 6,974,212 | 7,307,756 | 7,173,737 | 10/954,168 | 7,246,868 |
| 11/065,357 | 7,137,699 | 11/107,798 | 7,148,994 | 7,077,497 | 11/176,372 | 7,248,376 |
| 11/225,158 | 7,306,321 | 7,173,729 | 11/442,132 | 11/478,607 | 11/503,085 | 11/545,502 |
| 11/583,943 | 11/585,946 | 11/653,239 | 11/653,238 | 11/764,781 | 11/764,782 | 11/779,884 |
| 11/845,666 | 11/872,637 | 11/944,401 | 11/940,215 | 11/544,764 | 11/544,765 | 11/544,772 |
| 11/544,773 | 11/544,774 | 11/544,775 | 11/544,776 | 11/544,766 | 11/544,767 | 11/544,771 |
| 11/544,770 | 11/544,769 | 11/544,777 | 11/544,768 | 11/544,763 | 11/293,804 | 11/293,840 |
| 11/293,803 | 11/293,833 | 11/293,834 | 11/293,835 | 11/293,836 | 11/293,837 | 11/293,792 |
| 11/293,794 | 11/293,839 | 11/293,826 | 11/293,829 | 11/293,830 | 11/293,827 | 11/293,828 |
| 7,270,494 | 11/293,823 | 11/293,824 | 11/293,831 | 11/293,815 | 11/293,819 | 11/293,818 |
| 11/293,817 | 11/293,816 | 11/838,875 | 11/482,978 | 11/640,356 | 11/640,357 | 11/640,358 |
| 11/640,359 | 11/640,360 | 11/640,355 | 11/679,786 | 11/872,714 | 10/760,254 | 10/760,210 |
| 10/760,202 | 7,201,468 | 10/760,198 | 10/760,249 | 7,234,802 | 7,303,255 | 7,287,846 |
| 7,156,511 | 10/760,264 | 7,258,432 | 7,097,291 | 10/760,222 | 10/760,248 | 7,083,273 |
| 10/760,192 | 10/760,203 | 10/760,204 | 10/760,205 | 10/760,206 | 10/760,267 | 10/760,270 |
| 7,198,352 | 10/760,271 | 7,303,251 | 7,201,470 | 7,121,655 | 7,293,861 | 7,232,208 |
| 10/760,186 | 10/760,261 | 7,083,272 | 7,261,400 | 11/474,272 | 11/474,315 | 7,311,387 |
| 11/583,874 | 7,303,258 | 11/706,322 | 11/706,968 | 11/749,119 | 11/749,157 | 11/779,848 |
| 11/782,590 | 11/855,152 | 11/855,151 | 11/870,327 | 11/934,780 | 11/935,992 | 11/951,193 |
| 11/014,764 | 11/014,763 | 11/014,748 | 11/014,747 | 11/014,761 | 11/014,760 | 11/014,757 |
| 7,303,252 | 7,249,822 | 11/014,762 | 11/014,724 | 11/014,723 | 11/014,756 | 11/014,736 |
| 11/014,759 | 11/014,758 | 11/014,725 | 11/014,739 | 11/014,738 | 11/014,737 | 11/014,726 |
| 11/014,745 | 11/014,712 | 7,270,405 | 7,303,268 | 11/014,735 | 11/014,734 | 11/014,719 |
| 11/014,750 | 11/014,749 | 7,249,833 | 11/758,640 | 11/775,143 | 11/838,877 | 11/944,453 |

-continued

| | | | | | | |
|---|---|---|---|---|---|---|
| 11/944,633 | 11/955,065 | 11/014,769 | 11/014,729 | 11/014,743 | 11/014,733 | 7,300,140 |
| 11/014,755 | 11/014,765 | 11/014,766 | 11/014,740 | 7,284,816 | 7,284,845 | 7,255,430 |
| 11/014,744 | 11/014,741 | 11/014,768 | 11/014,767 | 11/014,718 | 11/014,717 | 11/014,716 |
| 11/014,732 | 11/014,742 | 11/097,268 | 11/097,185 | 11/097,184 | 11/778,567 | 11/852,958 |
| 11/852,907 | 11/872,038 | 11/955,093 | 11/961,578 | 11/293,820 | 11/293,813 | 11/293,822 |
| 11/293,812 | 11/293,821 | 11/293,814 | 11/293,793 | 11/293,842 | 11/293,811 | 11/293,807 |
| 11/293,806 | 11/293,805 | 11/293,810 | 11/688,863 | 11/688,864 | 11/688,865 | 11/688,866 |
| 11/688,867 | 11/688,868 | 11/688,869 | 11/688,871 | 11/688,872 | 11/688,873 | 11/741,766 |
| 11/482,982 | 11/482,983 | 11/482,984 | 11/495,818 | 11/495,819 | 11/677,049 | 11/677,050 |
| 11/677,051 | 11/872,719 | 11/872,718 | 7,306,320 | 11/934,781 | D528156 | 10/760,180 |
| 7,111,935 | 10/760,213 | 10/760,219 | 10/760,237 | 7,261,482 | 10/760,220 | 7,002,664 |
| 10/760,252 | 10/760,265 | 7,088,420 | 11/446,233 | 11/503,083 | 11/503,081 | 11/516,487 |
| 11/599,312 | 6,364,451 | 6,533,390 | 6,454,378 | 7,224,478 | 6,559,969 | 6,896,362 |
| 7,057,760 | 6,982,799 | 11/202,107 | 11/743,672 | 11/744,126 | 11/743,673 | 7,093,494 |
| 7,143,652 | 7,089,797 | 7,159,467 | 7,234,357 | 7,124,643 | 7,121,145 | 7,089,790 |
| 7,194,901 | 6,968,744 | 7,089,798 | 7,240,560 | 7,137,302 | 11/442,177 | 7,171,855 |
| 7,260,995 | 7,260,993 | 7,165,460 | 7,222,538 | 7,258,019 | 11/543,047 | 7,258,020 |
| 11/604,324 | 11/642,520 | 11/706,305 | 11/707,056 | 11/744,211 | 11/767,526 | 11/779,846 |
| 11/764,227 | 11/829,943 | 11/829,944 | 6,454,482 | 6,454,482 | 6,808,330 | 6,808,330 |
| 6,527,365 | 6,527,365 | 6,474,773 | 6,474,773 | 6,550,997 | 6,550,997 | 7,093,923 |
| 6,957,923 | 7,131,724 | 10/949,288 | 7,168,867 | 7,125,098 | 11/706,966 | 11/185,722 |
| 7,249,901 | 7,188,930 | 11/014,728 | 11/014,727 | D536031 | D531214 | 7,237,888 |
| 7,168,654 | 7,201,272 | 6,991,098 | 7,217,051 | 6,944,970 | 10/760,215 | 7,108,434 |
| 10/760,257 | 7,210,407 | 7,186,042 | 10/760,266 | 6,920,704 | 7,217,049 | 10/760,214 |
| 10/760,260 | 7,147,102 | 7,287,828 | 7,249,838 | 10/760,241 | 10/962,413 | 10/962,427 |
| 7,261,477 | 7,225,739 | 10/962,402 | 10/962,425 | 10/962,428 | 7,191,978 | 10/962,426 |
| 10/962,409 | 10/962,417 | 10/962,403 | 7,163,287 | 7,258,415 | 10/962,523 | 7,258,424 |
| 10/962,410 | 7,195,412 | 7,207,670 | 7,270,401 | 7,220,072 | 11/474,267 | 11/544,547 |
| 11/585,925 | 11/593,000 | 11/706,298 | 11/706,296 | 11/706,327 | 11/730,760 | 11/730,407 |
| 11/730,787 | 11/735,977 | 11/736,527 | 11/753,566 | 11/754,359 | 11/778,061 | 11/765,398 |
| 11/778,556 | 11/829,937 | 11/780,470 | 11/866,399 | 11/223,262 | 11/223,018 | 11/223,114 |
| 11/955,366 | 11/223,022 | 11/223,021 | 11/223,020 | 11/223,019 | 11/014,730 | D541849 |
| 29/279,123 | 6,716,666 | 6,949,217 | 6,750,083 | 7,014,451 | 6,777,259 | 6,923,524 |
| 6,557,978 | 6,991,207 | 6,766,998 | 6,967,354 | 6,759,723 | 6,870,259 | 10/853,270 |
| 6,925,875 | 10/898,214 | 7,095,109 | 7,145,696 | 10/976,081 | 7,193,482 | 7,134,739 |
| 7,222,939 | 7,164,501 | 7,118,186 | 7,201,523 | 7,226,159 | 7,249,839 | 7,108,343 |
| 7,154,626 | 7,079,292 | 10/980,184 | 7,233,421 | 7,063,408 | 10/983,082 | 10/982,804 |
| 7,032,996 | 10/982,834 | 10/982,833 | 10/982,817 | 7,217,046 | 6,948,870 | 7,195,336 |
| 7,070,257 | 10/986,813 | 10/986,785 | 7,093,922 | 6,988,789 | 10/986,788 | 7,246,871 |
| 10/992,748 | 10/992,747 | 7,187,468 | 10/992,828 | 7,196,814 | 10/992,754 | 7,268,911 |
| 7,265,869 | 7,128,384 | 7,164,505 | 7,284,805 | 7,025,434 | 7,298,519 | 7,280,244 |
| 7,206,098 | 7,265,877 | 7,193,743 | 7,168,777 | 11/006,734 | 7,195,329 | 7,198,346 |
| 7,281,786 | 11/013,363 | 11/013,881 | 6,959,983 | 7,128,386 | 7,097,104 | 11/013,636 |
| 7,083,261 | 7,070,258 | 7,083,275 | 7,110,139 | 6,994,419 | 6,935,725 | 11/026,046 |
| 7,178,892 | 7,219,429 | 6,988,784 | 11/026,135 | 7,289,156 | 11/064,005 | 7,284,976 |
| 7,178,903 | 7,273,274 | 7,083,256 | 11/064,008 | 7,278,707 | 11/064,013 | 6,974,206 |
| 11/064,004 | 7,066,588 | 7,222,940 | 11/075,918 | 7,018,025 | 7,221,867 | 7,290,863 |
| 7,188,938 | 7,021,742 | 7,083,262 | 7,192,119 | 11/083,021 | 7,036,912 | 7,175,256 |
| 7,182,441 | 7,083,258 | 7,114,796 | 7,147,302 | 11/084,757 | 7,219,982 | 7,118,195 |
| 7,229,153 | 6,991,318 | 7,108,346 | 11/248,429 | 11/239,031 | 7,178,899 | 7,066,579 |
| 11/281,419 | 11/298,633 | 11/329,188 | 11/329,140 | 7,270,397 | 7,258,425 | 7,237,874 |
| 7,152,961 | 11/478,592 | 7,207,658 | 11/484,744 | 7,311,257 | 7,207,659 | 11/525,857 |
| 11/540,569 | 11/583,869 | 11/592,985 | 11/585,947 | 7,306,307 | 11/604,316 | 11/604,309 |
| 11/604,303 | 11/643,844 | 11/650,553 | 11/655,940 | 11/653,320 | 7,278,713 | 11/706,381 |
| 11/706,323 | 11/706,963 | 11/713,660 | 7,290,853 | 11/696,186 | 11/730,390 | 11/737,139 |
| 11/737,749 | 11/740,273 | 11/749,122 | 11/754,361 | 11/766,043 | 11/764,775 | 11/768,872 |
| 11/775,156 | 11/779,271 | 11/779,272 | 11/829,938 | 11/839,502 | 11/858,852 | 11/862,188 |
| 11/859,790 | 11/872,618 | 11/923,651 | 11/950,255 | 11/930,001 | 11/955,362 | 11965718 |
| 6,485,123 | 6,425,657 | 6,488,358 | 7,021,746 | 6,712,986 | 6,981,757 | 6,505,912 |
| 6,439,694 | 6,364,461 | 6,378,990 | 6,425,658 | 6,488,361 | 6,814,429 | 6,471,336 |
| 6,457,813 | 6,540,331 | 6,454,396 | 6,464,325 | 6,443,559 | 6,435,664 | 6,412,914 |
| 6,488,360 | 6,550,896 | 6,439,695 | 6,447,100 | 09/900,160 | 6,488,359 | 6,637,873 |
| 10/485,738 | 6,618,117 | 10/485,737 | 6,803,989 | 7,234,801 | 7,044,589 | 7,163,273 |
| 6,416,154 | 6,547,364 | 10/485,744 | 6,644,771 | 7,152,939 | 6,565,181 | 10/485,805 |
| 6,857,719 | 7,255,414 | 6,702,417 | 7,284,843 | 6,918,654 | 7,070,265 | 6,616,271 |
| 6,652,078 | 6,503,408 | 6,607,263 | 7,111,924 | 6,623,108 | 6,698,867 | 6,488,362 |
| 6,625,874 | 6,921,153 | 7,198,356 | 6,536,874 | 6,425,651 | 6,435,667 | 10/509,997 |
| 6,527,374 | 10/510,154 | 6,582,059 | 10/510,152 | 6,513,908 | 7,246,883 | 6,540,332 |
| 6,547,368 | 7,070,256 | 6,508,546 | 10/510,151 | 6,679,584 | 10/510,000 | 6,857,724 |
| 10/509,998 | 6,652,052 | 10/509,999 | 6,672,706 | 10/510,096 | 6,688,719 | 6,712,924 |
| 6,588,886 | 7,077,508 | 7,207,654 | 6,935,724 | 6,927,786 | 6,988,787 | 6,899,415 |
| 6,672,708 | 6,644,767 | 6,874,866 | 6,830,316 | 6,994,420 | 6,954,254 | 7,086,720 |
| 7,240,992 | 7,267,424 | 7,128,397 | 7,084,951 | 7,156,496 | 7,066,578 | 7,101,023 |
| 11/165,027 | 11/202,235 | 11/225,157 | 7,159,965 | 7,255,424 | 11/349,519 | 7,137,686 |
| 7,201,472 | 7,287,829 | 11/504,602 | 7,216,957 | 11/520,572 | 11/583,858 | 11/583,895 |
| 11/585,976 | 11/635,488 | 7,278,712 | 11/706,952 | 11/706,307 | 7,287,827 | 11/944,451 |
| 11/740,287 | 11/754,367 | 11/758,643 | 11/778,572 | 11/859,791 | 11/863,260 | 11/874,178 |
| 11/936,064 | 11/951,983 | 6,916,082 | 6,786,570 | 10/753,478 | 6,848,780 | 6,966,633 |
| 7,179,395 | 6,969,153 | 6,979,075 | 7,132,056 | 6,832,828 | 6,860,590 | 6,905,620 |

-continued

| | | | | | | |
|---|---|---|---|---|---|---|
| 6,786,574 | 6,824,252 | 7,097,282 | 6,997,545 | 6,971,734 | 6,918,652 | 6,978,990 |
| 6,863,105 | 10/780,624 | 7,194,629 | 10/791,792 | 6,890,059 | 6,988,785 | 6,830,315 |
| 7,246,881 | 7,125,102 | 7,028,474 | 7,066,575 | 6,986,202 | 7,044,584 | 7,210,762 |
| 7,032,992 | 7,140,720 | 7,207,656 | 7,285,170 | 11/048,748 | 7,008,041 | 7,011,390 |
| 7,048,868 | 7,014,785 | 7,131,717 | 7,284,826 | 11/176,158 | 7,182,436 | 7,104,631 |
| 7,240,993 | 7,290,859 | 11/202,217 | 7,172,265 | 7,284,837 | 7,066,573 | 11/298,635 |
| 7,152,949 | 11/442,161 | 11/442,133 | 11/442,126 | 7,156,492 | 11/478,588 | 11/505,848 |
| 7,287,834 | 11/525,861 | 11/583,939 | 11/545,504 | 7,284,326 | 11/635,485 | 11/730,391 |
| 11/730,788 | 11/749,148 | 11/749,149 | 11/749,152 | 11/749,151 | 11/759,886 | 11/865,668 |
| 11/874,168 | 11/874,203 | 11/971,182 | 11/965,722 | 6,824,257 | 7,270,475 | 6,971,811 |
| 6,878,564 | 6,921,145 | 6,890,052 | 7,021,747 | 6,929,345 | 6,811,242 | 6,916,087 |
| 6,905,195 | 6,899,416 | 6,883,906 | 6,955,428 | 7,284,834 | 6,932,459 | 6,962,410 |
| 7,033,008 | 6,962,409 | 7,013,641 | 7,204,580 | 7,032,997 | 6,998,278 | 7,004,563 |
| 6,910,755 | 6,969,142 | 6,938,994 | 7,188,935 | 10/959,049 | 7,134,740 | 6,997,537 |
| 7,004,567 | 6,916,091 | 7,077,588 | 6,918,707 | 6,923,583 | 6,953,295 | 6,921,221 |
| 7,001,008 | 7,168,167 | 7,210,759 | 11/008,115 | 11/011,120 | 11/012,329 | 6,988,790 |
| 7,192,120 | 7,168,789 | 7,004,577 | 7,052,120 | 11/123,007 | 6,994,426 | 7,258,418 |
| 7,014,298 | 11/124,348 | 11/177,394 | 7,152,955 | 7,097,292 | 7,207,657 | 7,152,944 |
| 7,147,303 | 11/209,712 | 7,134,608 | 7,264,333 | 7,093,921 | 7,077,590 | 7,147,297 |
| 11/239,029 | 11/248,832 | 11/248,428 | 11/248,434 | 7,077,507 | 7,172,672 | 7,175,776 |
| 7,086,717 | 7,101,020 | 11/329,155 | 7,201,466 | 11/330,057 | 7,152,967 | 7,182,431 |
| 7,210,666 | 7,252,367 | 7,287,837 | 11/485,255 | 11/525,860 | 6,945,630 | 7,018,294 |
| 6,910,014 | 6,659,447 | 6,648,321 | 7,082,980 | 6,672,584 | 7,073,551 | 6,830,395 |
| 7,289,727 | 7,001,011 | 6,880,922 | 6,886,915 | 6,644,787 | 6,641,255 | 7,066,580 |
| 6,652,082 | 7,284,833 | 6,666,544 | 6,666,543 | 6,669,332 | 6,984,023 | 6,733,104 |
| 6,644,793 | 6,723,575 | 6,953,235 | 6,663,225 | 7,076,872 | 7,059,706 | 7,185,971 |
| 7,090,335 | 6,854,827 | 6,793,974 | 10/636,258 | 7,222,929 | 6,739,701 | 7,073,881 |
| 7,155,823 | 7,219,427 | 7,008,503 | 6,783,216 | 6,883,890 | 6,857,726 | 10/636,274 |
| 6,641,256 | 6,808,253 | 6,827,428 | 6,802,587 | 6,997,534 | 6,959,982 | 6,959,981 |
| 6,886,917 | 6,969,473 | 6,827,425 | 7,007,859 | 6,802,594 | 6,792,754 | 6,860,107 |
| 6,786,043 | 6,863,378 | 7,052,114 | 7,001,007 | 10/729,151 | 10/729,157 | 6,948,794 |
| 6,805,435 | 6,733,116 | 10/683,006 | 7,008,046 | 6,880,918 | 7,066,574 | 6,983,595 |
| 6,923,527 | 7,275,800 | 7,163,276 | 7,156,495 | 6,976,751 | 6,994,430 | 7,014,296 |
| 7,059,704 | 7,160,743 | 7,175,775 | 7,287,839 | 7,097,283 | 7,140,722 | 11/123,009 |
| 11/123,008 | 7,080,893 | 7,093,920 | 7,270,492 | 7,128,093 | 7,052,113 | 7,055,934 |
| 11/155,627 | 7,278,796 | 11/159,197 | 7,083,263 | 7,145,592 | 7,025,436 | 11/281,444 |
| 7,258,421 | 11/478,591 | 11/478,735 | 7,226,147 | 11/482,940 | 7,195,339 | 11/503,061 |
| 11/505,938 | 7,284,838 | 7,293,856 | 11/544,577 | 11/540,576 | 11/585,964 | 11/592,991 |
| 11/599,342 | 11/600,803 | 11/604,321 | 11/604,302 | 11/635,535 | 11/635,486 | 11/643,842 |
| 11/655,987 | 11/650,541 | 11/706,301 | 11/707,039 | 11/730,388 | 11/730,786 | 11/730,785 |
| 11/739,080 | 11/764,746 | 11/768,875 | 11/779,847 | 11/829,940 | 11/847,240 | 11/834,625 |
| 11/863,210 | 11/865,680 | 11/874,156 | 11/923,602 | 11/951,940 | 11/954,988 | 11/961,662 |
| 7,067,067 | 6,776,476 | 6,880,914 | 7,086,709 | 6,783,217 | 7,147,791 | 6,929,352 |
| 7,144,095 | 6,820,974 | 6,918,647 | 6,984,016 | 7,192,125 | 6,824,251 | 6,834,939 |
| 6,840,600 | 6,786,573 | 7,144,519 | 6,799,835 | 6,959,975 | 6,959,974 | 7,021,740 |
| 6,935,718 | 6,938,983 | 6,938,991 | 7,226,145 | 7,140,719 | 6,988,788 | 7,022,250 |
| 6,929,350 | 7,011,393 | 7,004,566 | 7,175,097 | 6,948,799 | 7,143,944 | 7,310,157 |
| 7,029,100 | 6,957,811 | 7,073,724 | 7,055,933 | 7,077,490 | 7,055,940 | 10/991,402 |
| 7,234,645 | 7,032,999 | 7,066,576 | 7,229,150 | 7,086,728 | 7,246,879 | 7,284,825 |
| 7,140,718 | 7,284,817 | 7,144,098 | 7,044,577 | 7,284,824 | 7,284,827 | 7,189,334 |
| 7,055,935 | 7,152,860 | 11/203,188 | 11/203,173 | 11/202,343 | 7,213,989 | 11/225,156 |
| 11/225,173 | 7,300,141 | 7,114,868 | 7,168,796 | 7,159,967 | 11/272,425 | 7,152,805 |
| 11/298,530 | 11/330,061 | 7,133,799 | 11/330,054 | 11/329,284 | 7,152,956 | 7,128,399 |
| 7,147,305 | 7,287,702 | 11/442,160 | 7,246,884 | 7,152,960 | 11/442,125 | 11/454,901 |
| 11/442,134 | 11/450,441 | 11/474,274 | 11/499,741 | 7,270,399 | 6,857,728 | 6,857,729 |
| 6,857,730 | 6,989,292 | 7,126,216 | 6,977,189 | 6,982,189 | 7,173,332 | 7,026,176 |
| 6,979,599 | 6,812,062 | 6,886,751 | 10/804,057 | 10/804,036 | 7,001,793 | 6,866,369 |
| 6,946,743 | 10/804,048 | 6,886,918 | 7,059,720 | 7,306,305 | 10/846,562 | 10/846,647 |
| 10/846,649 | 10/846,627 | 6,951,390 | 6,981,765 | 6,789,881 | 6,802,592 | 7,029,097 |
| 6,799,836 | 7,048,352 | 7,182,267 | 7,025,279 | 6,857,571 | 6,817,539 | 6,830,198 |
| 6,992,791 | 7,038,809 | 6,980,323 | 7,148,992 | 7,139,091 | 6,947,173 | 7,101,034 |
| 6,969,144 | 6,942,319 | 6,827,427 | 6,984,021 | 6,984,022 | 6,869,167 | 6,918,542 |
| 7,007,852 | 6,899,420 | 6,918,665 | 6,997,625 | 6,988,840 | 6,984,080 | 6,845,978 |
| 6,848,687 | 6,840,512 | 6,863,365 | 7,204,582 | 6,921,150 | 7,128,396 | 6,913,347 |
| 7,008,819 | 6,935,736 | 6,991,317 | 7,284,836 | 7,055,947 | 7,093,928 | 7,100,834 |
| 7,270,396 | 7,187,086 | 7,290,856 | 7,032,825 | 7,086,721 | 7,159,968 | 7,010,456 |
| 7,147,307 | 7,111,925 | 11/144,812 | 7,229,154 | 11/505,849 | 11/520,570 | 11/520,575 |
| 11/546,437 | 11/540,575 | 11/583,937 | 7,278,711 | 7,290,720 | 11/592,207 | 11/635,489 |
| 11/604,319 | 11/635,490 | 11/635,525 | 7,287,706 | 11/706,366 | 11/706,310 | 11/706,308 |
| 11/785,108 | 11/744,214 | 11/744,218 | 11/748,485 | 11/748,490 | 11/764,778 | 11/766,025 |
| 11/834,635 | 11/839,541 | 11/860,420 | 11/865,693 | 11/863,118 | 11/866,307 | 11/866,340 |
| 11/869,684 | 11/869,722 | 11/869,694 | 11/876,592 | 11/945,244 | 11/951,121 | 11/945,238 |
| 11/955,358 | 11/965,710 | 11/962,050 | | | | |

BACKGROUND OF THE INVENTION

The Applicant has developed a wide range of printers that employ pagewidth printheads instead of traditional reciprocating printhead designs. Pagewidth designs increase print speeds as the printhead does not traverse back and forth across the page to deposit a line of an image. The pagewidth printhead simply deposits the ink on the media as it moves past at high speeds. Such printheads have made it possible to perform full colour 1600 dpi printing at speeds in the vicinity of 60 pages per minute, speeds previously unattainable with conventional inkjet printers.

The high resolution and print speeds are largely due to the self cooling operation of the printheads. Excess heat does not build up in the nozzles because it is removed from the printhead with the ejected ink drops. This allows the nozzles to be closer together and the nozzle firing rate is limited only by the ink refill rate. The self cooling operation relies on low ejection energies which in turn correspond to small nozzles and low drop volumes. Another factor that assists low energy ejection is a short nozzle aperture length. The nozzles define a geometric shape (typically circular or elliptical) and the aperture length is the thickness of the structure (such as a nozzle plate) which defines the nozzle. A long nozzle aperture length has a high fluidic drag on the ink drop as it is ejected through the nozzle. The Applicant's printhead designs keep the nozzle aperture length relatively short (less than 5 microns).

The small nozzles clog easily and paper dust or dried ink on the nozzle face (the exterior surface defining the array of nozzle apertures) can cause color mixing between closely spaced nozzles of different color. The paper dust and other contaminants can be removed by wiping the nozzle face. However, contact pressure with wiper is critical for effective cleaning. Unfortunately, the pressure needed for effective cleaning can damage the delicate structures of the printhead IC.

SUMMARY OF THE INVENTION

Accordingly, the present invention provides a printhead assembly for an inkjet printer, the printhead assembly comprising:

an elongate printhead IC having a nozzle face defining an array of nozzles;

a support structure for supporting the elongate printhead IC on an external surface such that its length is transverse to a media feed direction through the printer; wherein, the external surface being configured such that it has a section that is flush with a long side edge of the elongate printhead IC.

The invention mounts the printhead ICs so that a wiping surface is guided on to the nozzle face rather impacting on a side of the printhead IC sitting proud of the mounting surface. This allows the wiper to effectively clean the nozzle face without using a contact pressure that damages the delicate nozzle structures. The Applicant's work has found that a printhead IC mounted such that it sits proud of the external surface requires a wiper to have a high contact force for it to clean the nozzle face. However, the force is damaging to the printhead IC and in particular the edge that first contacts the wiper. Reducing the contact force causes the wiper blade to bounce off the edge of the printhead IC and bounce several times across the nozzle face. Consequently, the wiper does not contact the nozzle face at several points and hence fails to clean away contaminants.

Preferably, the printhead assembly has a plurality of elongate printhead ICs mounted end to end on the support structure such that in use the printhead assembly is a pagewidth printhead and the long side edge of each of the printhead ICs align with each other. Preferably, the support structure has an epoxy resin adjacent the long side edges of the printhead ICs, the epoxy resin being profiled such that it is flush with the nozzle faces of the printhead ICs. Preferably, the printhead ICs each have a line of wire bonds along a trailing long side edge opposite the long side edge adjacent the epoxy resin. Preferably, the epoxy resin is thixotropic prior to setting. Preferably, the wire bonds are encased in encapsulant profiled to present a surface inclined upwardly from the nozzle face. Preferably, the nozzle face is planar. In a further preferred form, the nozzle face is lithographically deposited silicon dioxide. Optionally, the nozzle face is lithographically deposited silicon nitride. Preferably, the printhead assembly is provided as a printhead cartridge for user insertion and removal from a printer.

BRIEF DESCRIPTION OF THE DRAWINGS

Preferred embodiments of the invention will now be described by way of example only, with reference to the accompanying drawings, in which.

DETAILED DESCRIPTION OF THE PREFERRED EMBODIMENTS

Figure 1:
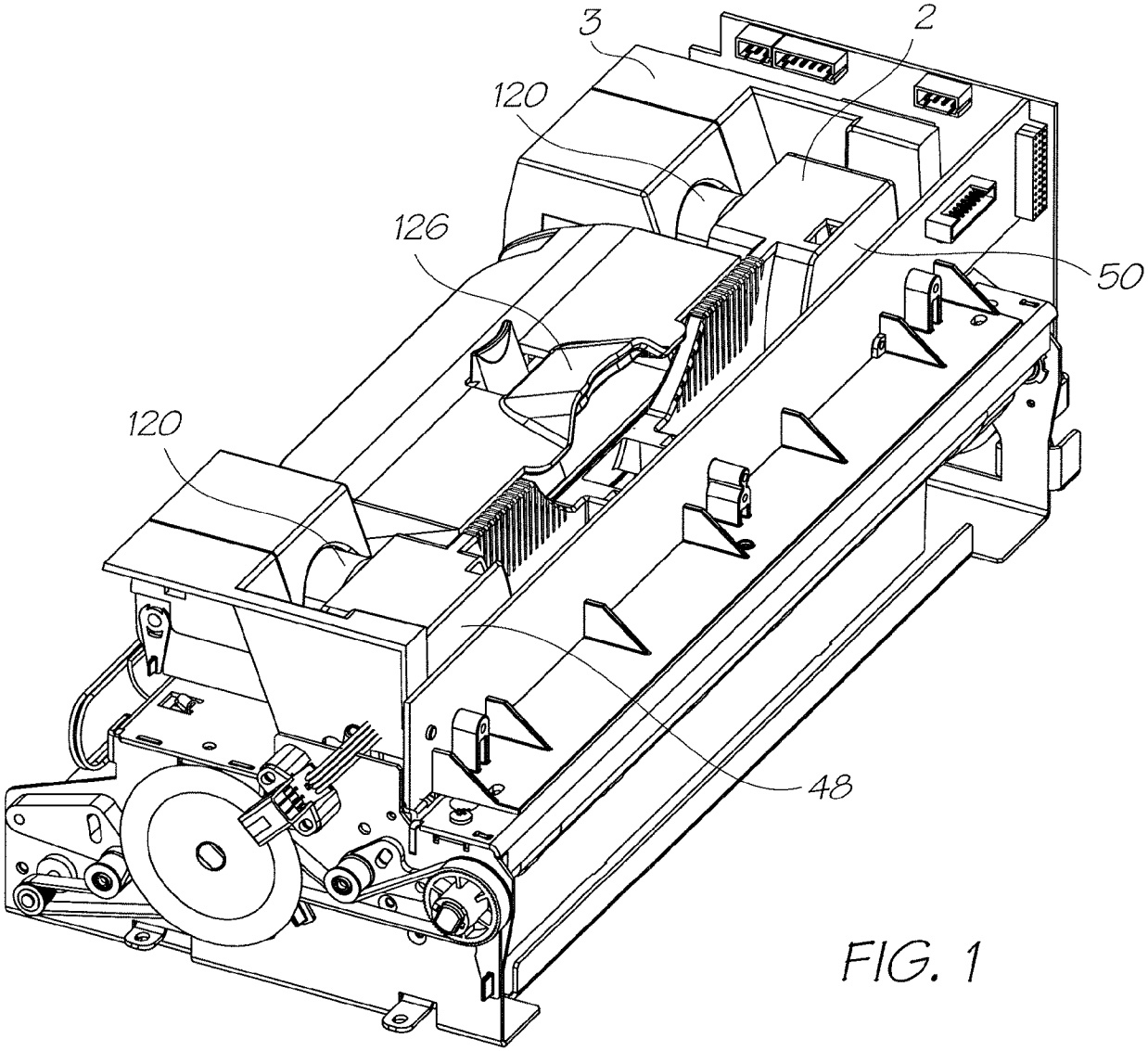
FIG. 1 shows the printhead cartridge of the present invention installed the print engine of a printer.
Figure 2:
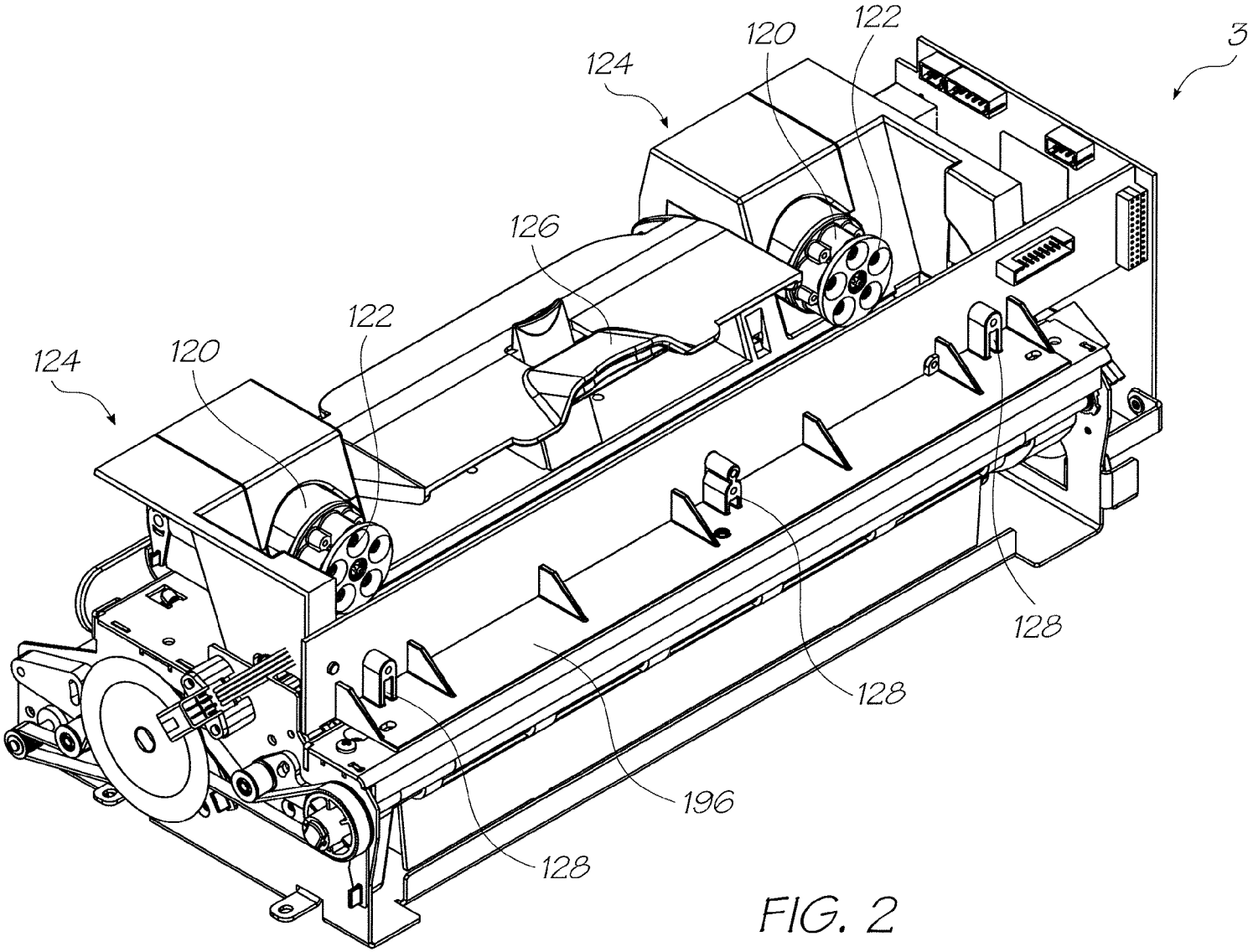
FIG. 2 shows the print engine without the printhead cartridge installed to expose the inlet and outlet ink couplings.

FIG. 1 shows a printhead cartridge 2 installed in a print engine 3. The print engine 3 is the mechanical heart of a printer which can have many different external casing shapes, ink tank locations and capacities, as well as different media feed and collection trays. The printhead cartridge 2 is inserted and removed by the user lifting and lowering the latch 126. The print engine 3 forms an electrical connection with contacts on the printhead cartridge 2 and a fluid coupling is formed via the sockets 120 and the inlet and outlet manifolds, 48 and 50 respectively. FIG. 2 shows the print engine 3 with the printhead cartridge removed to reveal the apertures 122 in each of the sockets 120. Each aperture 122 receives one of the spouts 52 on the inlet and outlet manifolds. As discussed above, the ink tanks have an arbitrary position and configuration but simply connect to hollow spigots 124 at the rear of the sockets 120.

Figure 3:
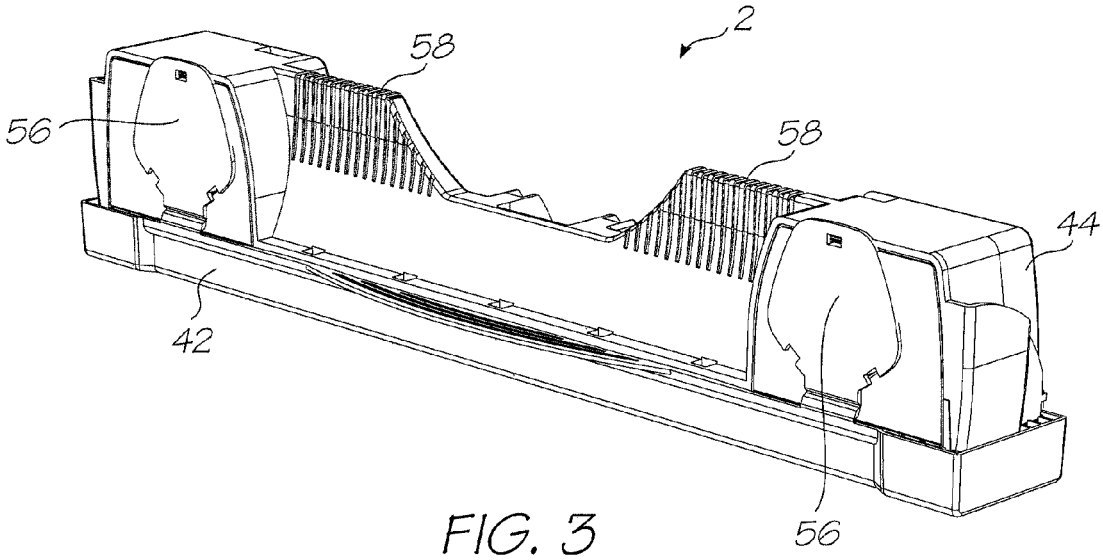
FIG. 3 is a perspective of the complete printhead cartridge according to the present invention.

FIG. 3 is a perspective of the complete printhead cartridge 2. The printhead cartridge 2 has a top molding 44 and a removable protective cover 42. The top molding 44 has a central web for structural stiffness and to provide grip textured surfaces 58 for manipulating the cartridge during insertion and removal. The base portion of the protective cover 42 protects the printhead ICs (not shown) and line of contacts (not shown) prior to installation in the printer. Caps 56 are integrally formed with the base portion and cover the ink inlets and outlets (see 54 and 52 of FIG. 5).

Figure 4:
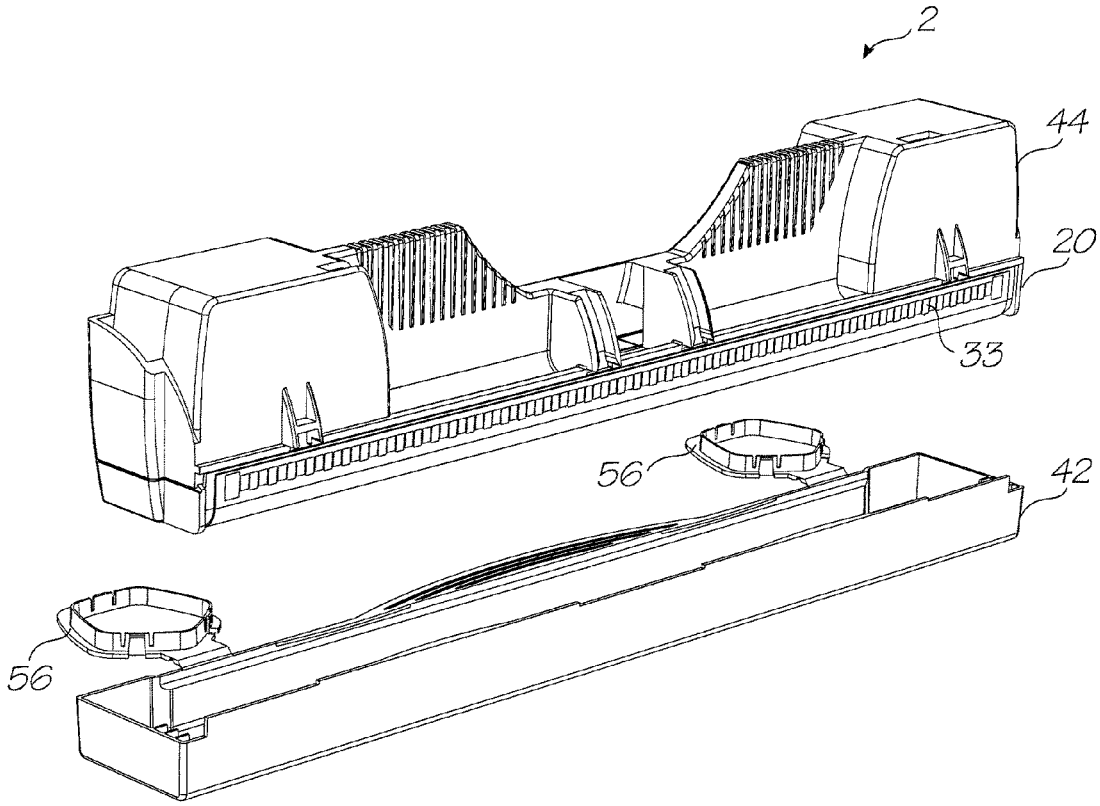
FIG. 4 shows the printhead cartridge of FIG. 3 with the protective cover removed.
Figure 5:
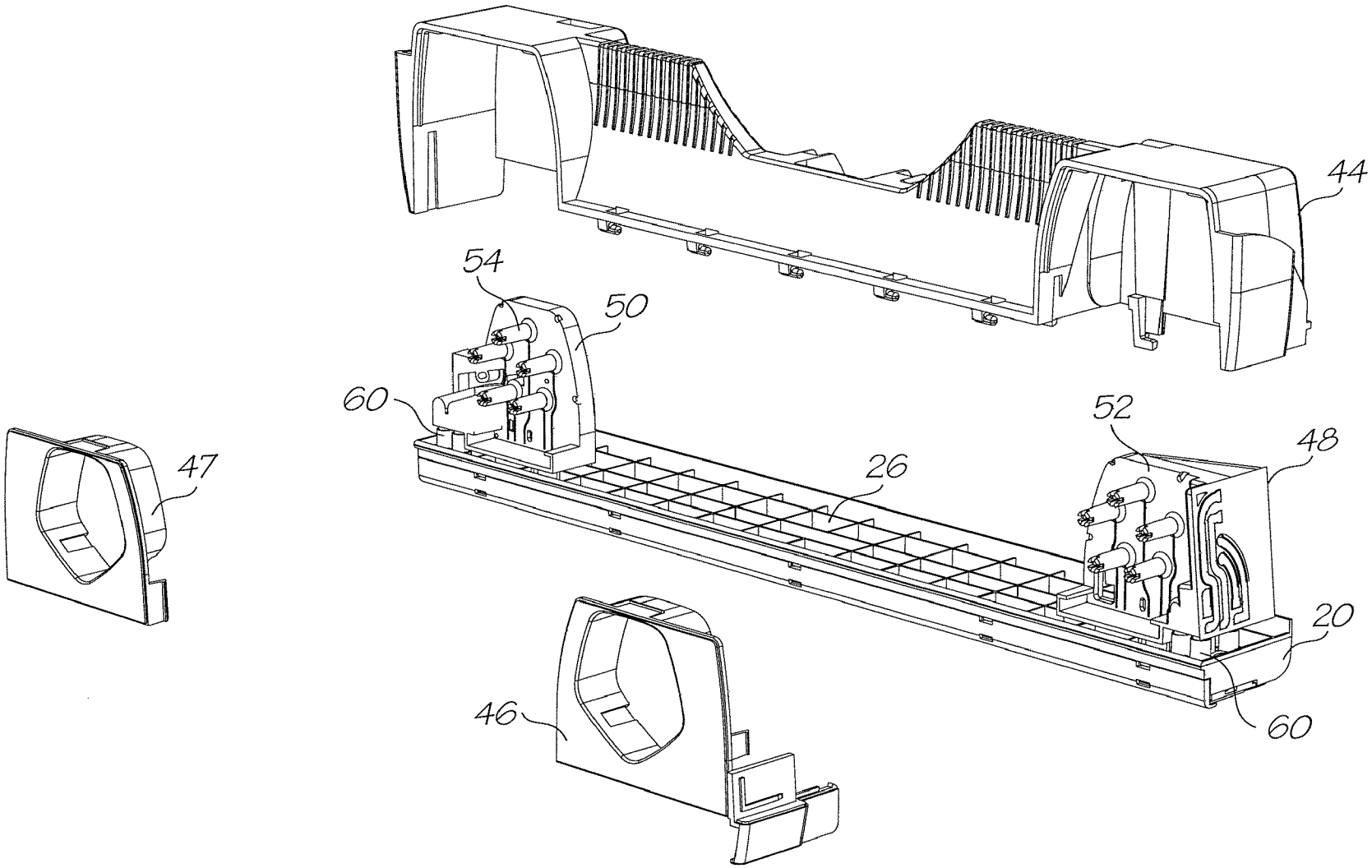
FIG. 5 is an exploded is a partial perspective of the printhead assembly within the printhead cartridge of FIG. 3.

FIG. 4 shows the printhead assembly 2 with its protective cover 42 removed to expose the printhead ICs on the bottom surface and the line of contacts 33 on the side surface. The protective cover is discarded to the recycling waste or fitted to the printhead cartridge being replaced to contain leakage from residual ink. FIG. 5 is a partially exploded perspective of the printhead assembly 2. The top cover 44 has been removed reveal the inlet manifold 48 and the outlet manifold 50. The inlet and outlet shrouds 46 and 47 have been removed to better expose the five inlet and outlet spouts 52. The inlet and outlet manifolds 48 and 50 form a fluid connection between each of the individual inlets and outlets and the corresponding main channel in the LCP molding. The main channel extends the length of the LCP molding and it feeds a series of fine channels on the underside of the LCP molding. A line of air cavities are formed above each of the main channels 24. Any shock waves or pressure pulses in the ink are damped by compressing the air the air cavities.

Figure 6:
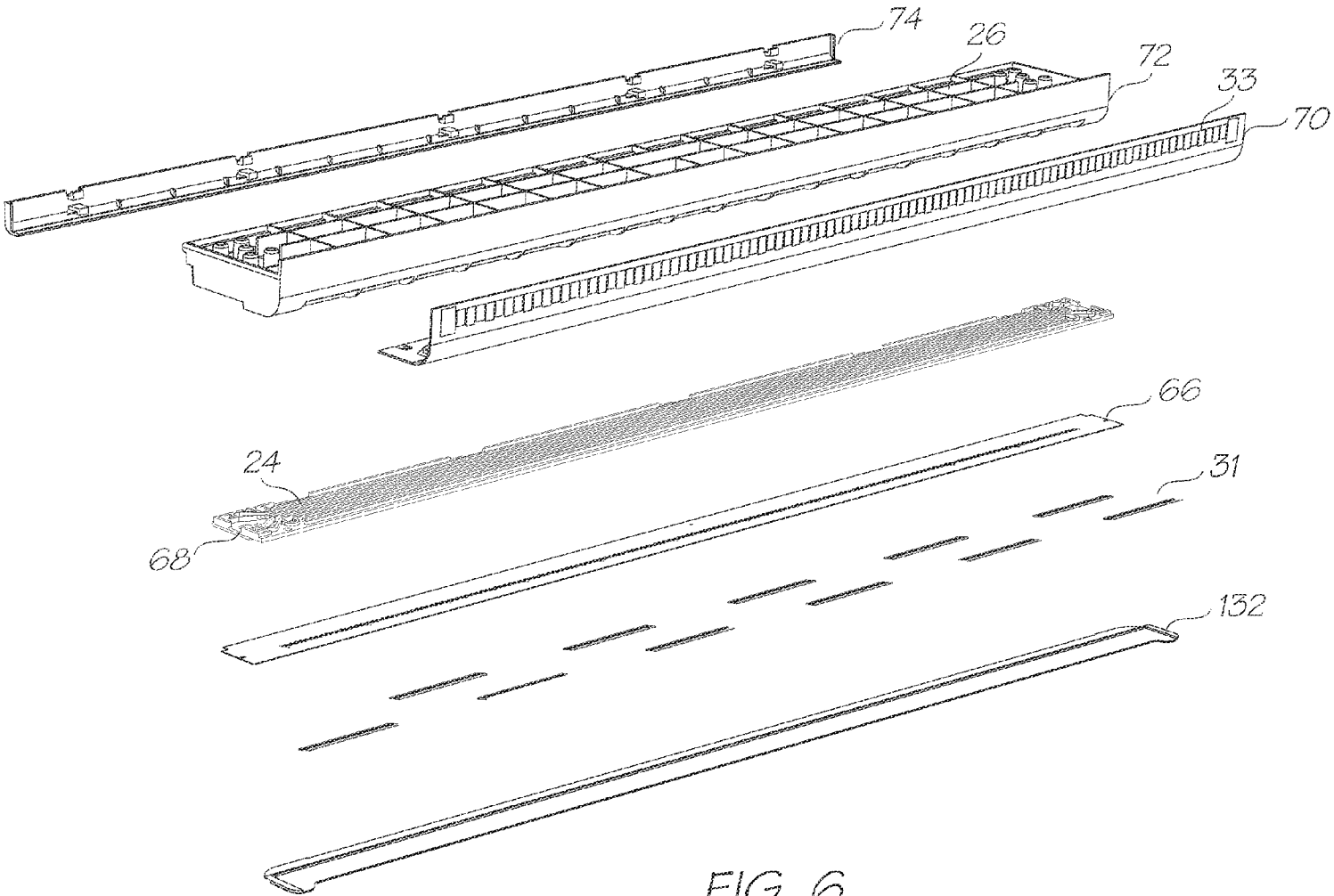
FIG. 6 is an exploded perspective of the printhead assembly without the inlet or outlet manifolds or the top cover molding; and, FIGS. 7A and 7B are partial section views of the printhead assembly with the wiper blade cleaning the nozzle face.

FIG. 6 is an exploded perspective of the printhead assembly without the inlet or outlet manifolds or the top cover molding. The main channels 24 for each ink color and their associated air cavities 26 are formed in the channel molding 68 and the cavity molding 72 respectively. Adhered to the bottom of the channel molding 68 is a die attach film 66. The die attach film 66 mounts the printhead ICs 31 to the channel molding such that the fine channels on the underside of the channel molding 68 are in fluid communication with the printhead ICs 31 via small laser ablated holes through the film.

Both the channel molding 68 and the top cover molding 72 are molded from LCP (liquid crystal polymer) because of its stiffness and coefficient of thermal expansion that closely matches that of silicon. It will be appreciated that a relatively long structure such as a pagewidth printhead should minimize any thermal expansion differences between the silicon substrate of the printhead ICs 31 and their supporting structure.

Figure 7A:
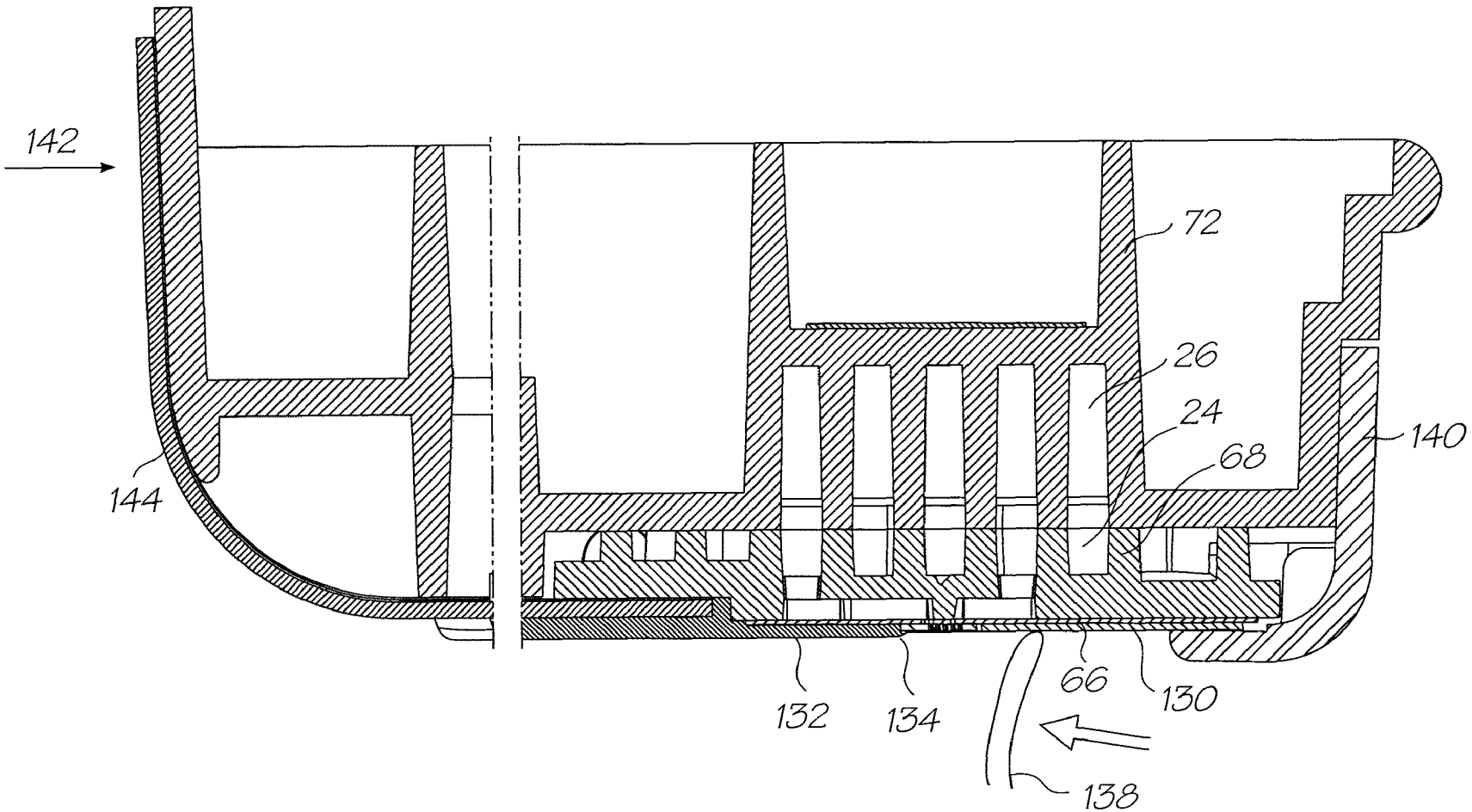
Figure 7B:
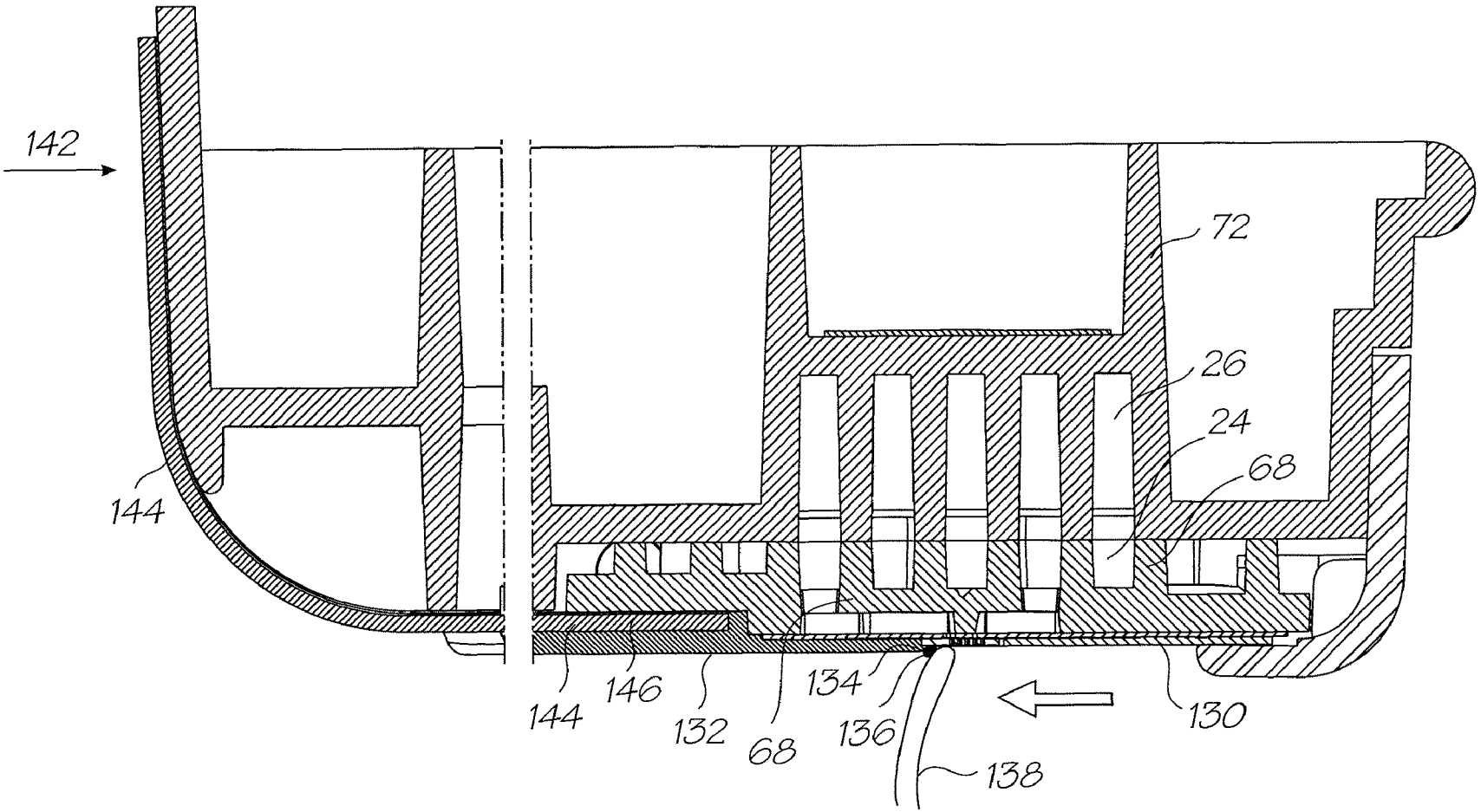

FIGS. 7A and 7B are partial section views of the printhead assembly being cleaned by a wiper blade actuated by the printhead maintenance facility of the print engine 3. The operation of the printhead maintenance facility is described in detail in the Applicant's copending U.S. patent application Ser. No. 12/014,771, the contents of which is incorporated by reference. FIG. 7A shows the cavity molding 72 with the air cavities 26, the channel molding 68 defining the main channels 24. A die attach film 66 is adhered to the underside of the channel molding 68 and the printhead ICs 31 are mounted end to end to extend the width of the print media. A paper guide 140 attaches to the front of the LCP moldings 68 and 72. This sets the gap between the nozzles and the media substrate during printing.

A layer of epoxy resin 130 is applied to the die attach film 66. The resin layer 130 contacts the wiper blade 138 as it moves across the exterior face of the printhead assembly. The thickness of the resin layer 130 is controlled such that it is flush with the nozzle faces of the printhead ICs 31. This essentially grouts the step created by the side of the printhead ICs 31. With the resin layer 130 guiding the wiper blade 138 onto the nozzle face, the front edges of the printhead ICs are shielded from hard impacts with the wiper. Consequently, there is less damage and wear to the printhead ICs 31 and the wiper can clean effectively using only a modest contact force. Impact with the front edge of the nozzle face can cause the wiper blade to bounce and lose contact with the printhead IC.

The printhead ICs are fabricated such that the nozzle face is planarized. A flat nozzle face cleans more easily as dust and contaminants have little to anchor to apart from the nozzle openings themselves. This process has been described in detail in the Applicant co-pending U.S. Ser. No. 11/877,667, the contents of which are incorporated by reference. Briefly, the nozzle structures have a layer of photo resist deposited over them which is then sealed under a nozzle face layer of silicon oxide and or silicon nitride. The relatively hard silicon nitride or silicon oxide has better wear resistance than printhead ICs with a nozzle face of polymer resist material.

FIG. 7B shows the wiper blade 138 at the trailing edge of the printhead IC 31. The wiper pushes a bead 136 of dust and contaminants ahead of itself. At the trailing edge is a bead of encapsulant material 132. The encapsulant 132 encases the wire bonds (not shown) that transmit power and print data to the printhead ICs 31. The power and data are fed from the print engine controller (not shown) to a line of contacts 142 at the edge of a flex PCB 144. The flex PCB 144 wraps around to a recessed surface 146 on the underside of the printhead assembly. Recessing the flex PCB relative to the printhead IC lowers the height of the wire bond loops and therefore allows the encapsulant bead 132 to be lower. The Applicant uses this to advantage by profiling the encapsulant bead 132 to form an inclined surface 134 ramping up from the nozzle face of the printhead IC. The inclined surface 134 pushes the contaminant bead 136 firmly up onto the wiper 138. When the wiper 138 eventually lifts off the exterior surface, the contaminant bead 136 is much less likely to remain on the printhead.

For convenience, the encapsulant 132 and the epoxy resin layer 130 are the same polymer material. The polymer material should be thixotropic; that is, it should not flow under its own weight. In this way, the encapsulant 132 and the grout epoxy 130 can be accurately profiled and shaped without risk of the material flowing to a different shape.

The invention claimed is:

1. A printhead assembly for an inkjet printer, the printhead assembly comprising: an elongate printhead IC having a nozzle face defining an array of nozzles; a support structure for supporting the elongate printhead IC on an external surface such that its length is transverse to a media feed direction through the printer, the support structure has an epoxy resin adjacent a long side edge of the printhead IC, the epoxy resin being profiled such that the epoxy resin is flush with the nozzle face of the printhead IC, and the printhead IC has a line of wire bonds along a trailing long side edge opposite the long side edge adjacent the epoxy resin; wherein, the external surface being configured such that it has a section that is flush with the long side edge of the elongate printhead IC.

2. A printhead assembly according to claim 1 wherein the printhead assembly has a plurality of elongate printhead ICs mounted end to end on the support structure such that in use the printhead assembly is a pagewidth printhead and the long side edge of each of the printhead ICs align with each other.

3. A printhead assembly according to claim 1 wherein the epoxy resin is thixotropic prior to setting.

4. A printhead assembly according to claim 1 wherein the wire bonds are encased in encapsulant profiled to present a surface inclined upwardly from the nozzle face.

5. A printhead assembly according to claim 1 wherein the nozzle face is planar.

6. A printhead assembly according to claim 1 wherein the nozzle face is lithographically deposited silicon dioxide.

7. A printhead assembly according to claim 6 wherein the nozzle face is lithographically deposited silicon nitride.

8. A printhead assembly according to claim 1 wherein the printhead assembly is provided as a printhead cartridge for user insertion and removal from a printer.

* * * * *